US006122798A

United States Patent [19]

Kobayashi et al.

[11] Patent Number: 6,122,798

[45] Date of Patent: Sep. 26, 2000

[54] DUST SUCTION HEAD FOR ELECTRIC VACUUM CLEANER

[75] Inventors: Toshinari Kobayashi, Ono; Kenji Aida, Kasai; Kazuo Saito, Hyogo-ken; Akihiko Zako, Kakogawa; Sadaki Kodera, Kasai; Keiichi Sato, Himeji; Toshiyuki Fujiyoshi; Yoshihiro Mori, both of Kasai, all of Japan

[73] Assignee: Sanyo Electric Co., Ltd., Moriguchi, Japan

[21] Appl. No.: 09/141,138

[22] Filed: Aug. 27, 1998

[30] Foreign Application Priority Data

| | | | |
|---|---|---|---|
| Aug. 29, 1997 | [JP] | Japan | 9-234443 |
| Sep. 18, 1997 | [JP] | Japan | 9-253582 |
| Sep. 29, 1997 | [JP] | Japan | 9-264471 |

[51] Int. Cl.[7] ..... A47L 5/10

[52] U.S. Cl. ..... 15/387; 15/386

[58] Field of Search ..... 15/387, 386

[56] References Cited

U.S. PATENT DOCUMENTS

| | | | |
|---|---|---|---|
| 1,209,721 | 12/1916 | Kirby | 15/387 |
| 1,209,722 | 12/1916 | Kirby | 15/387 |
| 1,323,925 | 12/1919 | Stewart | 15/387 X |
| 1,915,073 | 6/1933 | Svensson | 15/387 |
| 2,331,692 | 10/1943 | Hunt . | |
| 2,777,152 | 1/1957 | Cosentino . | |
| 2,993,224 | 7/1961 | Child | 15/387 |
| 5,802,666 | 9/1998 | Jung . | |

FOREIGN PATENT DOCUMENTS

| | | |
|---|---|---|
| 0 451 401 | 10/1991 | European Pat. Off. . |
| 0 728 434 | 8/1996 | European Pat. Off. . |
| 96 28081 | 9/1996 | WIPO . |

*Primary Examiner*—Chris K. Moore
*Attorney, Agent, or Firm*—Armstrong, Westerman, Hattori, McLeland & Naughton

[57] ABSTRACT

A dust suction head for use in an electric vacuum cleaner, having an air suction port at the bottom of the head. The head has a brush chamber which accommodates therein a freely rotatable brush having blades that extend along the shaft of the rotational brush. The head additionally has an opening and an air passage connected with the opening for taking in and leading fresh air into the vacuum chamber of the cleaner through the brush chamber such that the fresh air passing through the brush chamber impinges on the blades to accelerate the rotational motion of the blades. Thus, the head can obtain a necessary amount of air to rotate the brush at all times, especially when it is brushing a carpet, and maintain its smooth motion on the floor while dusting it.

22 Claims, 44 Drawing Sheets

DUST SUCTION HEAD FOR ELECTRIC VACUUM CLEANER

FIELD OF THE INVENTION

The invention relates to an improvement in dust suction head of an electric vacuum cleaner, and in particular, such dust suction head is suitable for vacuum cleaning not only a hard surface such as a hard floor and a table top but also a soft surface such as a sofa and a carpet.

BACKGROUND OF THE INVENTION

A typical electric vacuum cleaner is provided, at one end of a tube connected with its motor, with means for collecting dust (hereinafter referred to as dust suction head). The suction head has a rotational brush adapted to collect dust on a floor while air is sucked by the motor from a dust suction port of the head. The brush is driven by an electric motor or a turbine.

However, such head is heavy and very complex in structure, so that it not only has limited portability but also requires many parts and complicated processes for assembly.

In a vacuum cleaner having a turbine for rotating the brush, the turbine is normally installed in a turbine chamber formed in an air passage en route from the dust suction port of the head to the air outlet of the head, so that the turbine is rotated by the air flow through it. As a result, dust can accumulate in the turbine chamber, hindering the rotation of the turbine.

In order to overcome these problems, a new rotational brush was disclosed in such early Japanese patent publications as No. 9-28630. The brush has two turbines mounted on the opposite ends thereof. The turbines are rotated by fresh air taken into the chamber. The fresh air is then taken into the vacuum chamber together with the air sucked from the dust suction port of the head.

In this arrangement, since the two turbines are required on the opposite end of the rotational brush, they require a number of extra parts and must be designed so as not to loose dust suction power even while much air is sucked to rotate the two turbines. In other words, the turbines must be designed so that is can rotate by a small amount of air. However, such turbines are likely to fail to rotate at a desired speed when the head is placed on a resistive carpeted floor, for example. Furthermore, the dust suction port formed in the bottom of the turbine chamber is limited in length, since it is difficult to form a dust suction port right under the turbines. As a result, the head, having a much smaller width than the dust suction head, can sweep only a limited area of the floor, leaving dust behind it.

SUMMARY OF THE INVENTION

It is, therefore, an object of the present invention is to provide a dust suction head for use in an electric vacuum cleaner, which is simple in structure and yet capable of driving its rotational brush efficiently.

There is provided, in accordance with one aspect of the present invention, a dust suction head for use in an electric vacuum cleaner, comprising:

a body having in the bottom thereof an air suction port;

a brush chamber formed in said body;

a freely rotational brush mounted on a shaft within said rotational brush chamber and having a multiplicity of blades mounted on said shaft along the length of said shaft such that said blades extend closely to said dust suction port; and an opening formed in said body for taking in fresh air and guiding the fresh air to said blades so as to rotate said rotational brush.

In this arrangement, fresh air may be introduced from the opening onto the blades of the rotational brush to thereby rotate the brush without a turbine for driving the brush as in the prior art. The rotational force provided by the fresh air may prevent the blades of the brush from sticking on a resistive floor such as a carpet, thereby facilitating a smooth move of the dust suction head on the floor and improving operability of the dust suction head.

In accordance with another aspect of the invention, there is provided a dust suction head for use in an electric vacuum cleaner, comprising:

a body having in the bottom thereof an air suction port;

a brush chamber formed in said body;

a freely rotatable brush (hereinafter referred to as rotational brush) mounted on a shaft within said brush chamber and having a multiplicity of blades mounted on said shaft along the length of said shaft such that said blades extend closely to said dust suction port; and an opening formed in said body at a position ahead of said rotational brush, for taking in fresh air and guiding the fresh air to said blades so as to rotate said rotational brush.

In this example, fresh air may be introduced from the opening, as in the preceding example, and further onto the blades of the rotational brush that are situated ahead of the shaft, to thereby facilitating the rotation of the brush more efficiently without resorting to a turbine for driving the brush as in the prior art. The rotational force provided by the fresh air may prevent the blades of the brush from sticking on a resistive floor such as a carpet, thereby facilitating a smooth move of the dust suction head on the floor and improving operability of the dust suction head.

In this example, an air passage may be provided for leading the fresh air from the opening to the blades located below the shaft of the rotational brush. Such air passage facilitates counter-clockwise rotation of the brush when the fresh air is drawn past the downward blades into the body of the vacuum chamber. The air passage further has an advantage that the fresh air will blow up the dust in the stream of air into the vacuum chamber.

At least a portion of the blades of the rotational brush may be made of a material having poor permeability so that the fresh air from the opening may be efficiently captured by the blades thereby providing a larger torque to the rotational brush.

The blades are preferably bent or inclined in the direction opposite to the direction of the rotation. Such bent or inclined blades may receive the fresh air efficiently, so that they may acquire larger torques. Thus, if the dust suction head is placed on the floor, the rotational brush can promptly start rotation.

The opening is preferably provided in the central portion (i.e. center of the width) of the body of the dust suction head. The fresh air, thus, taken in from the central opening will impinges on the central portion of the rotational brush at a high fluid velocity, since the fluid velocity of the air is maximum near the connection tube which is close to the central portion of the rotational brush 11. Hence, the central opening facilitates efficient rotation of the brush 11.

The air passage is preferably formed to lead the fresh air to the blades ahead of the shaft of the rotational brush. In this case, the opening may be positioned at any convenient point of the upper case, so that the body may have a neat configuration. For example, the opening may have a configuration which is convenient to lead the fresh air in the direction which coincides with the rotation of the brush and onto the blades so as to prompt the rotation of the blades.

An air guide may also be formed to guide the fresh air from the opening to a point below the shaft of the rotational brush so that all of the fresh air impinges on the blades from below thereby driving the blades in the direction of rotation of the brush. Thus, when the fresh air is drawn into the vacuum chamber together with the air taken in from the dust suction port, it facilitates the rotation of the blades.

The blades of the rotational brush may be mounted on the shaft in a helical configuration to spiral in one direction, for example. At the same time the opening may also be formed in the form of a spiral which spirals in the opposite direction of the blades. The blades and the flow of fresh air then cross each other so that many of the blades receive the fresh air evenly while the fresh air is delivered to them. This also contributes to the efficient rotation of the brush.

The brush chamber preferably has a round transverse cross section (in a plane perpendicular to the axis of the shaft of the rotational brush). Such simple design of the brush chamber renders the configuration of the dust suction head simple and compact.

The rotational brush is preferably movable in the vertical direction. Then the tips of the rotational brush may be adjusted in height in response to protrusions and recesses on the floor, so that the rotational brush always acquires an optimum level and may carry out efficient brushing of the floor.

The shaft of the rotational brush may be provided with additional blades for receiving the fresh air to help the rotation of the brush. The additional blades will function as a turbine to promote the rotation of the brush.

BRIEF DESCRIPTION OF THE DRAWINGS

The foregoing and other objects, features and advantages of the present invention will be apparent from the following detailed description of the preferred embodiments of the invention reference being made to the accompanying drawings in which like reference numerals indicate like parts throughout the figures and in which.

DETAILED DESCRIPTION OF THE PREFERRED EMBODIMENT

Figure 1:
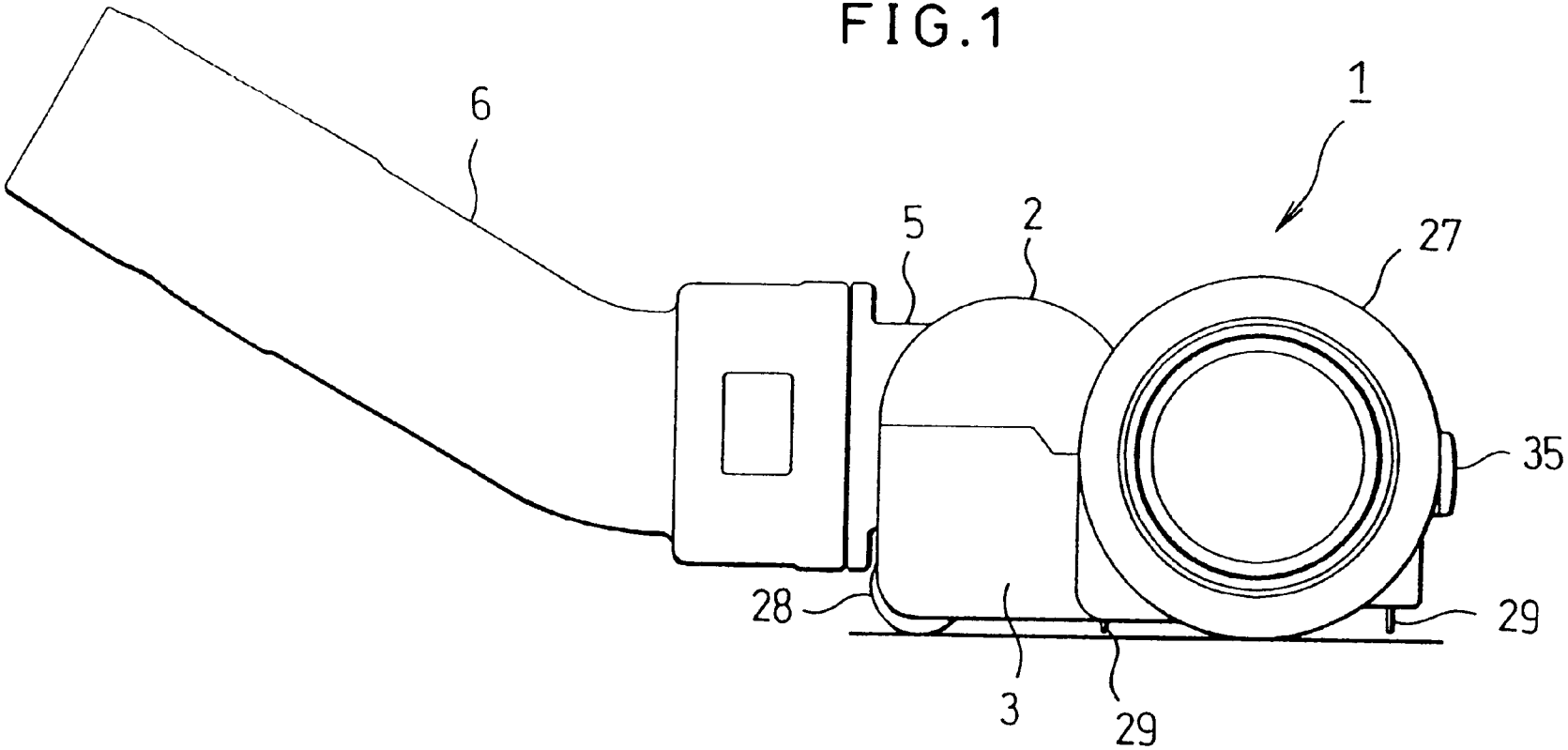
FIG. 1 is a side view of the first example of a dust suction head according to the invention.

Referring to FIGS. 1–7, there is shown a first exemplary dust suction head 1. The dust suction head 1 includes an upper case 2, a lower case 3, a lid 4 which is removably mounted on the upper case 2 and the lower case 3, a rotatable tube 5 which is supported in vertically movable condition between the upper case 2 and the lower case 3, and a connection tube 6 rotatably supported by rotatable tube 5.

The body 1 is provided in the bottom thereof with an air suction port 7, a brush chamber 8 for accommodating a rotational brush 11 inside the body 1.

Located on the opposite sides of the body 1 are shaft supports 9, which rotatably support wheels 27 as described later.

A pair of partitioning ribs 10 are formed to extend from the upper and the lower cases 2 and 3, respectively, for partitioning the chamber 8 from the shaft supports 9, so as to prevent air from being drawn into the brush chamber 8 through the shaft supports 9.

The freely rotational brush 11 is installed in the brush chamber 8, facing the air suction port 7. The rotational brush 11 consists of a shaft 12, two pairs of spiral blades 15 and 16 mounted on the shaft 12 with the bases 14 of the blades inserted in spiral grooves 13 formed along the length and on the surface of the shaft 12.

Formed at the opposite ends of the shaft 12 of the rotational brush 11 are protruding arbors 112. Holding caps 111 are secured on the protruding arbors 112 for keeping the first and the second blades 15 and 16, respectively, in position. The protruding arbors 112 are rotatably supported by respective bearings 113 mounted on the partitioning ribs 10.

In the example shown herein, each of the first pair of blades 15 has a form of brush. Each of the second pair of blades 16 is composed of a fabric 17 and a plastic base 18 molded at one end of the fabric 17. The base 18 is secured in the spiral groove 13. Stitched on the other end of the base 18 is a brush member 19. The base 18 is inserted in the spiral groove 13. The fabric 17 is deformable, so they can bend along the length of the shaft 12. The blade 16 is mounted on the shaft 12 in such a way that the tip of the blade 16 is bent or curved in the direction opposite to the rotational direction of the brush 11, that is, the blade 16 (or brush member 19) is bent so as to capture air in the concave section thereof and to facilitate the rotation of the brush 11.

Figure 6:
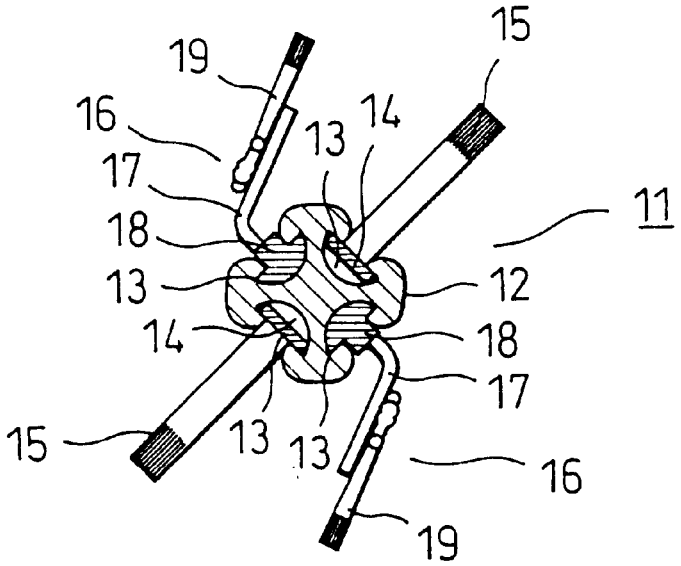
FIG. 6 is a transverse cross section of the rotational brush of the first dust suction head of FIG. 1, showing the condition of the rotational brush at rest.
Figure 7:
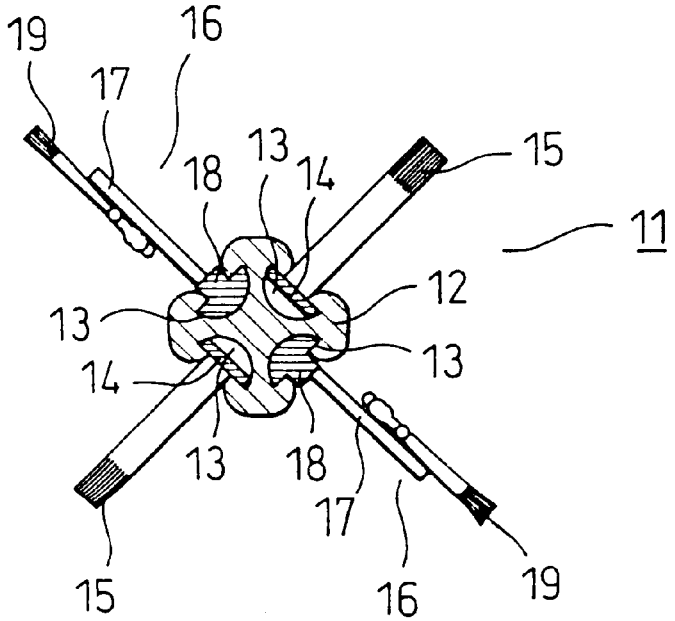
FIG. 7 is a transverse cross section of the rotational brush of the first dust suction head of FIG. 1, showing the condition of the rotational brush in rotational motion.

Accordingly, each of the second blades 16 is bent towards the direction of rotation of the brush 11 when the brush 11 is at rest or in motion at a low speed, as shown in FIG. 6. When the second blade 16 is rotated at a high speed, it will stretch straight in the radial direction due to a centrifugal force, as shown in FIG. 7.

Blades 15 and 16 are designed not to touch the floor when they are at rest. The radii of the blades 16 are larger than those of blades 15 when they are rotated at a high speed and fully extended in the radial direction.

In order to distribute fresh air in the brush chamber 8, the lid 4 is provided with an opening 20 that extends the entire length of the blades 15 and 16. The lid 4 is also provided with a first rib 21 at the front side of the opening 20, a second rib 22 defining the bottom of opening 20, and a cover 24 above the second rib 22, with these members together defining the air passage 26.

A fresh air induction port 23 is formed at the end of the air passage 26 in such a way that it projects downwardly and directly above the upper front part of the circular locus of the blades 16.

A cover 24 is mounted on the lid 4 with latching pawls 25 so as to cover and hide the fresh air induction port 23.

The air passage 26 formed by the first and the second rib 21 and 22, respectively, and the cover 24 narrows as it extends from the opening 20 to fresh air induction port 23.

A pair of front wheels 27 are mounted on the shaft supports 9. The wheels 27 have substantially the same radius of the body 1 of the dust suction head. Rear wheels 28 are mounted at the rear end of the body 1 of the dust suction head.

Provided at the front and the rear ends of the air suction port 7 are a pair of suction keepers 29. The suction keepers 29 are made of a resilient material such as soft rubber. The suction keepers 29 prevent suction of air from outside of air suction port 7, to thereby enhance suction of air from a space between air suction port 7 and a carpet, for example, and sucking the dust which has fallen deep in the carpet.

In this arrangement, a free end of the connection tube 6 may be connected to the body of the vacuum cleaner a via resilient hose and an extension tube. If an electric blower, connected with the connection tube 6, is operated, air is taken in from air suction port 7. When the body 1 is lifted upward from the floor, most of air is taken in from suction port 7 since then the suction port 7 is open free and the air flow resistance through the suction port 7 is small. Under this condition, the velocity of air taken in through the suction port 7 is relatively low and little air is introduced from the opening 20, so that the rotational brush 11 is not rotated by the air flow.

Figure 2:
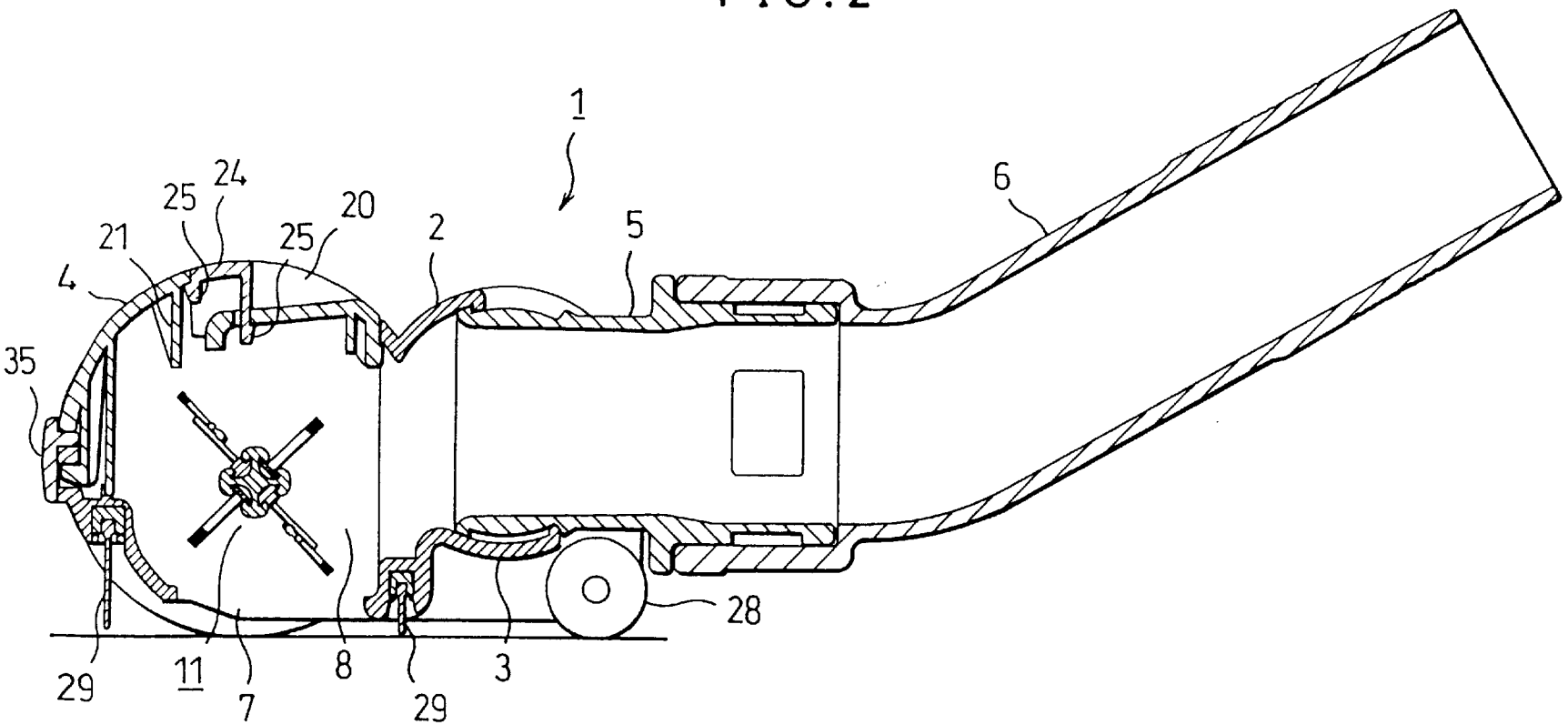
FIG. 2 is a longitudinal cross section of the first dust suction head shown in FIG. 1.
Figure 3:
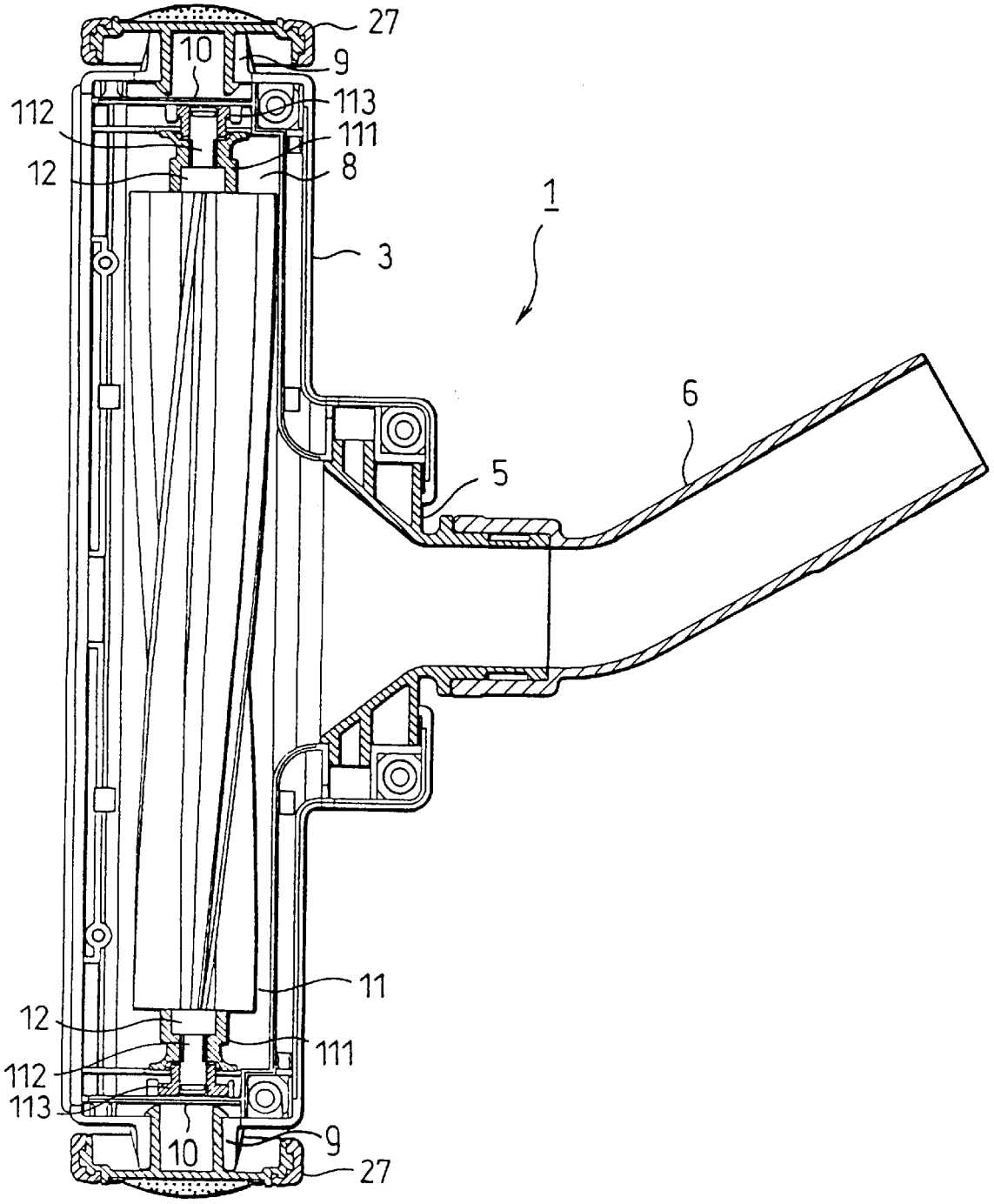
FIG. 3 is a horizontal cross section of the first dust suction head shown in FIG. 1.
Figure 4:
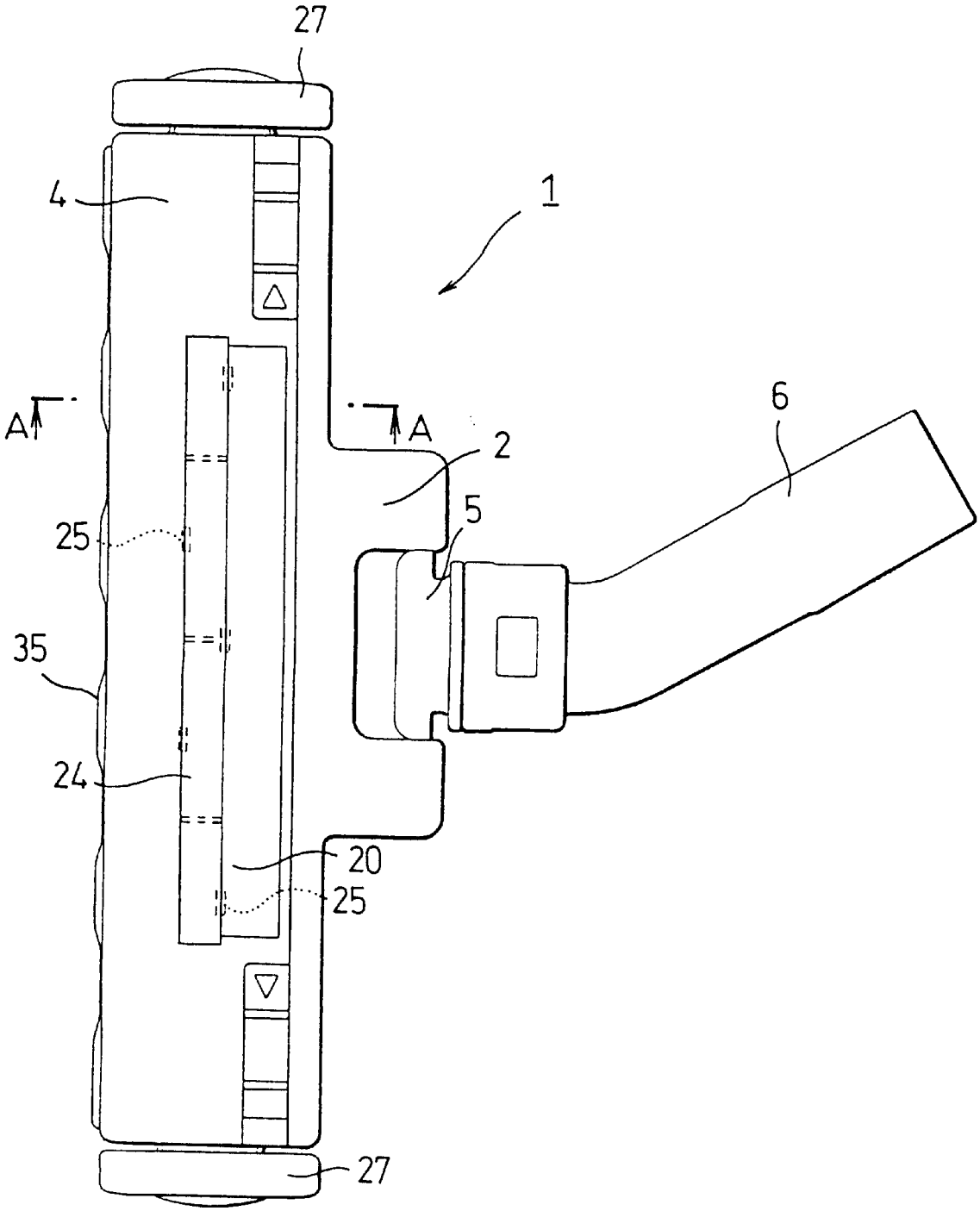
FIG. 4 is a plan view of the first dust suction head shown in FIG. 1.
Figure 5:
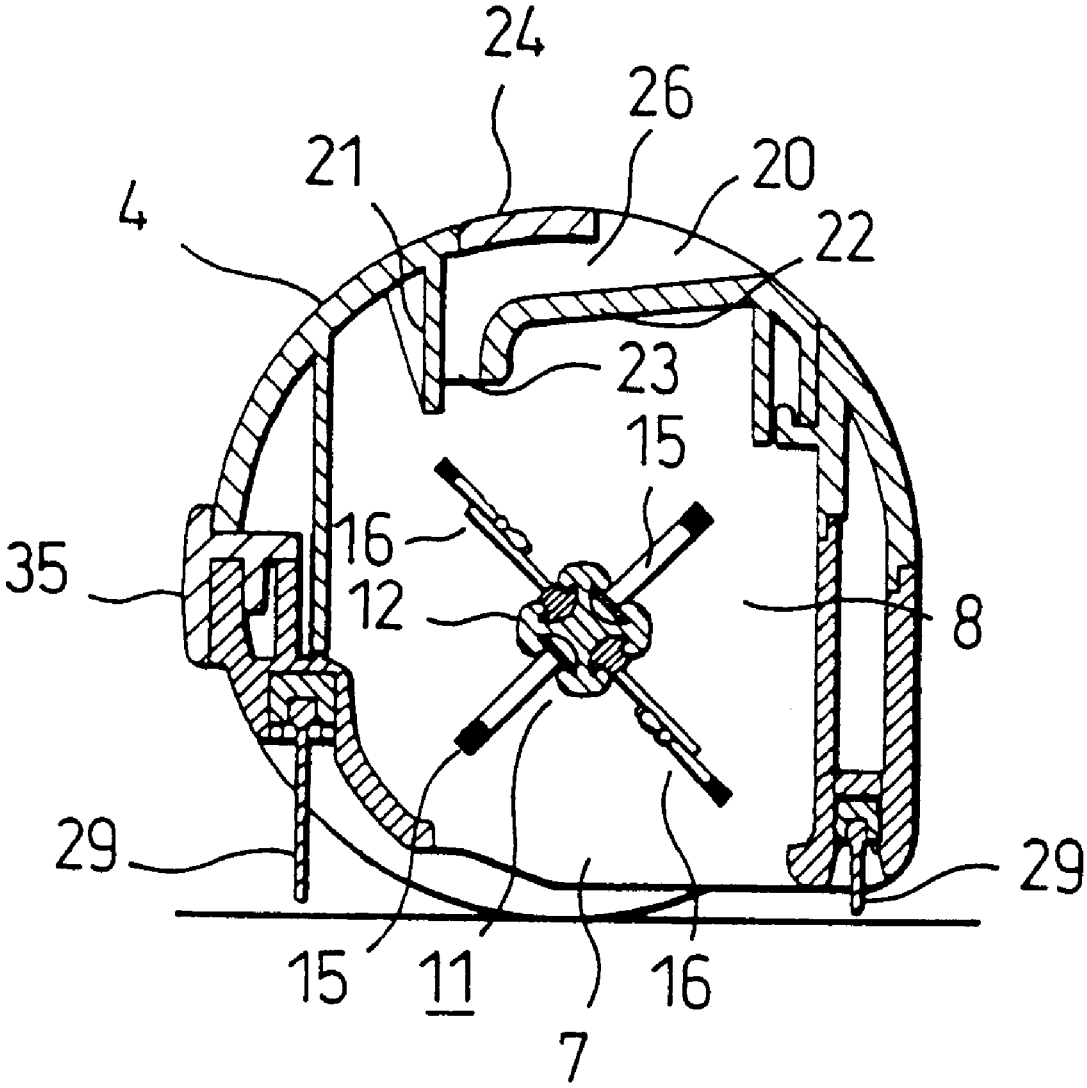
FIG. 5 is a vertical cross section of the first dust suction head shown in FIG. 1.

If the body 1 is placed on a floor such as tatami mat or a flooring to be cleaned, a small gap is formed between the floor and the air suction port 7, through which the air is drawn by the electric motor at a high speed, creating a high speed air flow that impinges on the first and the second blades 15 and 16, thereby rotating the brush 11 in the counter-clockwise direction as shown in FIGS. 2 and 5.

When the rotational brush 11 is at rest or in motion at a low speed, the blades 16 are accelerated efficiently by the air taken in through the suction port 7 and impinging thereon, since the blades 16 are curved towards the direction of its rotation as shown in FIG. 6.

As the rotational brush 11 is rotated at a high speed, the blades 16 are stretched to their full length by centrifugal forces, as shown in FIG. 7. Under this condition, the blades 16 may touch a tatami mat or floor, brushing it without hurting the floor, since the tips of the blades 16 are brush member 19 stitched on the soft resilient fabric 17.

On the other hand, when cleaning a soft floor such as a carpet, the suction port 7 is covered almost completely with the soft floor, increasing the flow resistance of air that passes through the suction port 7, resulting in an increase in the air flow through the opening 20. The fresh air induction port 23 has an extremely small cross section as compared with the suction port 7, so that the air flow through the fresh air induction port 23 is passed onto the first and the second blades 15 and 16 of the rotational brush 11, causing the brush 11 to be rotated in the counter-clockwise direction as shown in FIGS. 2 and 5.

Since the first and the second ribs 21 and 22, respectively, forming the fresh air induction port 23, extend downwardly close to the circular locus of the tips of the blades 16, the air taken in through the fresh air induction port 23 will impinges on the blades 15 and 16, and then drawn into the connection tube 6. Furthermore, since the fresh air induction port 23 extends straight in parallel with the shaft 12, the fresh air is induced to various sections of the helical extending blades 15 and 16, irrespective of the angular positions thereof, so that the blades 15 and 16 are accelerated accordingly, and get rotated efficiently by the air.

The air flow generates noise as it is lead in a passage if the cross section of the passage varies abruptly. Therefore, it would be appreciated that the narrowing passage 26 only suppresses noise of the air flow as it leads the fresh air from the opening 20 to the fresh air induction port 23. In addition, the narrowing passage 26 increases the speed of air flow toward the air induction port 23. Hence, the narrowing passage 26 provides an accelerated air flow to the first and the second blades 15 and 16, respectively, which facilitates efficient rotation of the brush 11.

The flow of air from the opening 20 may prevent the dust suction head 1 from adhering to the floor, thereby increasing the operability of the dust suction head 1.

When the dust suction head is in operation on a carpet, frictional resistance of the carpet can hinder the motion of the rotational brush 11 and lower the speed of the bush 11. As the rotational brush is slowed down, the centrifugal force acting on the blades 16 is reduced, so that the blades 16 begins to contract by restoring their original configurations, thereby reducing the rotational radii thereof and hence the frictional resistance. As a result, the rotational brush 11 restores its speed. Repeating these steps continuously, the rotational brush 11 may substantially maintain a constant speed.

It would be remembered that each of the blades 16 has a brush member 19 stitched on the fabric 17. The brush member 19 may bend easily, and its weight generates significant centrifugal force to extend the blade 16, facilitating keeping the constancy of the rotational speed of the brush 11.

It would be apparent that the blades 16 may alternatively be formed of an elastic material such as a rubber, instead of the fabric member 17, the base 18 and the brush member 19.

In the example shown hereinabove, the air passage 26 is an elongate slit. However, the air passage 26 may be divided into a multiplicity of smaller slits in order to prevent the blades 15 and 16 from contacting the first and the second ribs 21, and 22, respectively, when the lid 4 is bent towards the inside of the brush chamber 8 caused by a negative pressure in the brush chamber 8, especially when the strength of the lid 4 has lowered after a long period of use.

Figure 8:
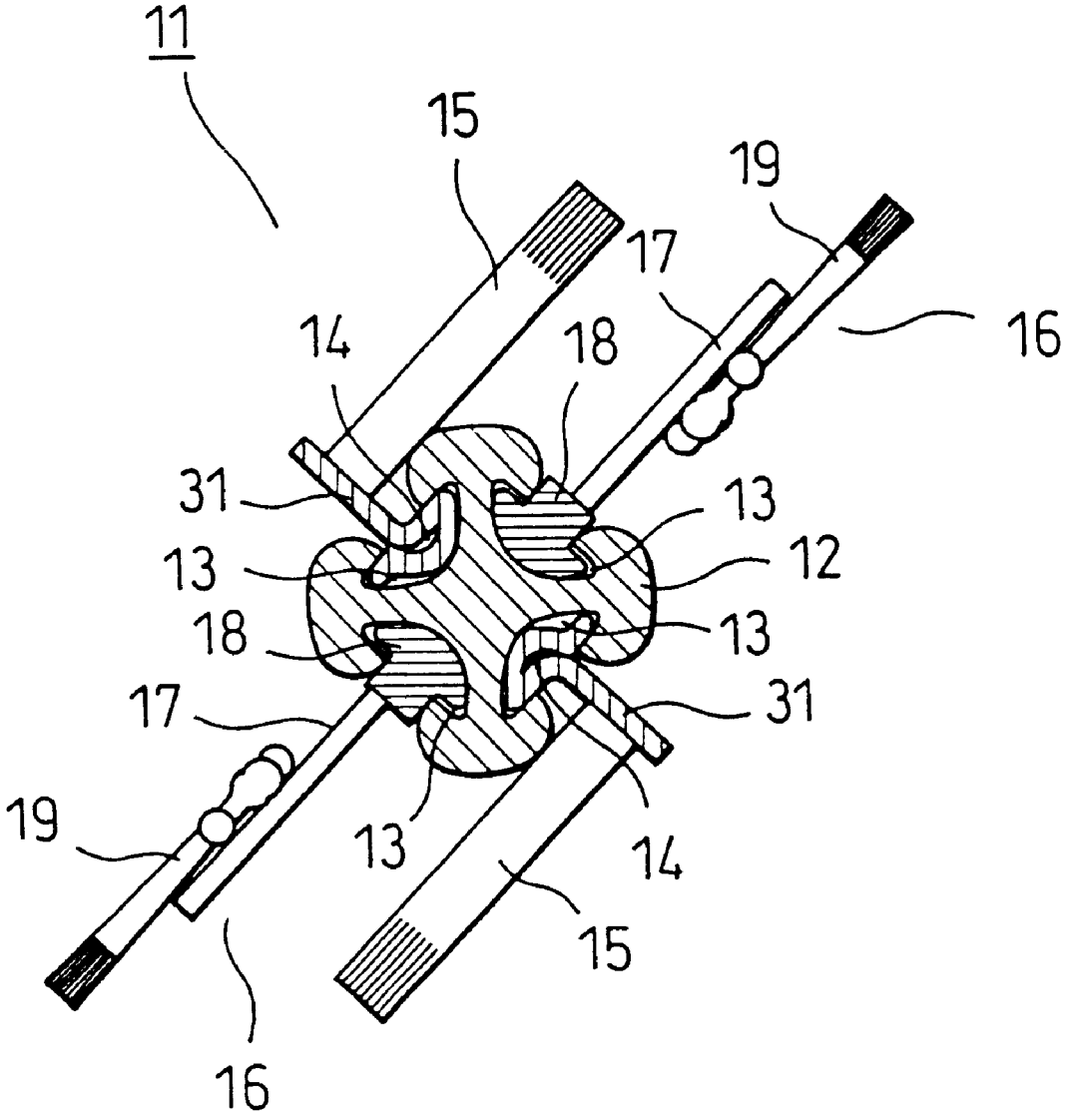
FIG. 8 is a transverse cross section of the second rotational brush for use in a dust suction head according to the invention.

It will be apparent to those skilled in the art that the rotational brush 11 is not limited to the example shown above: it may have many different forms. For example, the first blade 15 may be formed by: a relatively hard fabric member 31 which is bent at one end thereof, inserted in one of two helical grooves 13 formed in the shaft 12, and secured therein by glue, for example, thereby forming a base 14 of the blades; and a brush member implanted at the free end of the fabric member 31, as shown in FIG. 8. The second blade 16 may be formed and secured in one of another pair of helical grooves 13 in the same manner as in the aforementioned example, but without bending it.

In this case, the first blades 15 are mounted on the shaft 12 with their tips inclined in the direction opposite to the rotational direction so that it can be rotated easily by the air flow when it is at rest. Consequently, as the brush 11 is rotated, the first blades 15 tend to stand upright on the shaft 12. Thus, the first blades 15, as shown in FIG. 8, play the same role as the second blades 16, as described in the preceding example, in keeping the rotational brush 11 at substantially a constant speed.

Figure 9A:
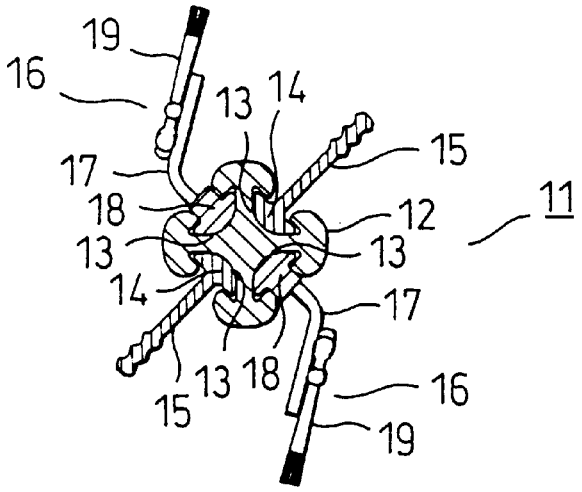
FIGS. 9A and 9B show transverse cross sections of another exemplary rotational brush of the invention when the brush is at rest (FIG. 9A), and when the brush is in operation (FIG. 9B).
Figure 9B:
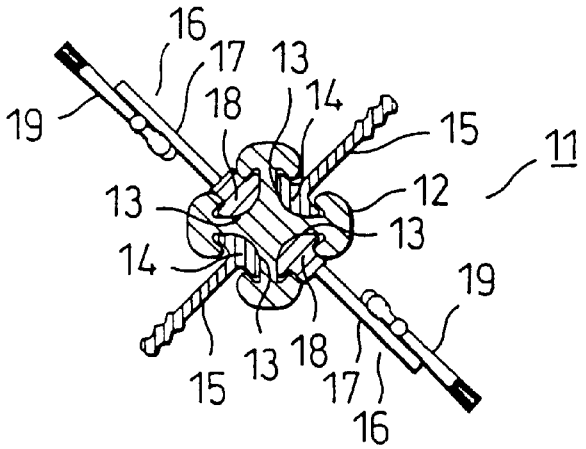
Figure 9C:
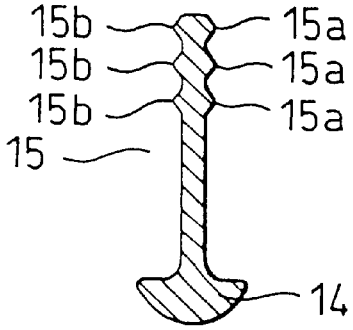
FIG. 9C shows a detailed cross section of the blades 15 of the rotational brush.

FIG. 9 shows another example of a rotational brush 11 of the invention. The rotational brush 11 includes an extruded aluminum shaft 12 having four helical grooves which are cut along the length of the shaft 12 and are angularly spaced apart by 90° about the axis of the shaft 12. The rotational brush also includes the first and the second sets of blades secured alternately in the grooves. Thus, the blades have the same helical configuration as the grooves. In addition, the first pair of the blades 15 are disposed on the opposite sides of the shaft 12 to keep them in good balance, and so are the second pair of the blades, thereby providing smooth rotation of the rotational brush 11.

The first blades 15 are each made of a soft resilient impermeable material such as soft polyvinyl chloride (PVC) or soft rubber (e.g. urethane rubber) integral with the base 14. Formed on both sides near the tips of the first blades 15 are a multiplicity of projections 15*a* and 15*b* extending along the length thereof, as shown in more detail in FIG. 9C. The length of the first blades 15 between the root and the tips thereof is a little smaller than the corresponding length of the second blades 16 and is about the same as the length of long plush of a carpet sucked into the rotational bush.

On the other hand, each of the second blades 16 is formed of a poorly permeable soft fabric 17, a molded plastic base 18 at one end of the fabric 17 and a blush member 19 stitched at the other end of the fabric 17. The fabric 17 having the molded base is soft enough to bend and waves along the shaft 12 together with the stitched brush member 19. The second blade 16 is secured on the shaft 12 such that it is generally bent in the direction of the rotational of the brush 11 (counter-clockwise direction) as shown in FIG. 9A when it is at rest. When the rotational brush 11 is at rest, the first and the second blades 15 and 16 will not touch the floor if the dust suction head is placed on the floor.

The second blade 16, which is bent as described above when it is at rest or in rotation at a low speed, will be straighten in the radial direction when it is rotated at a high speed due to centrifugal force, as shown in 9B, so that the tip of the second blade 16 extends beyond the circular locus of the first blades 15 and touches the floor.

Figure 10:
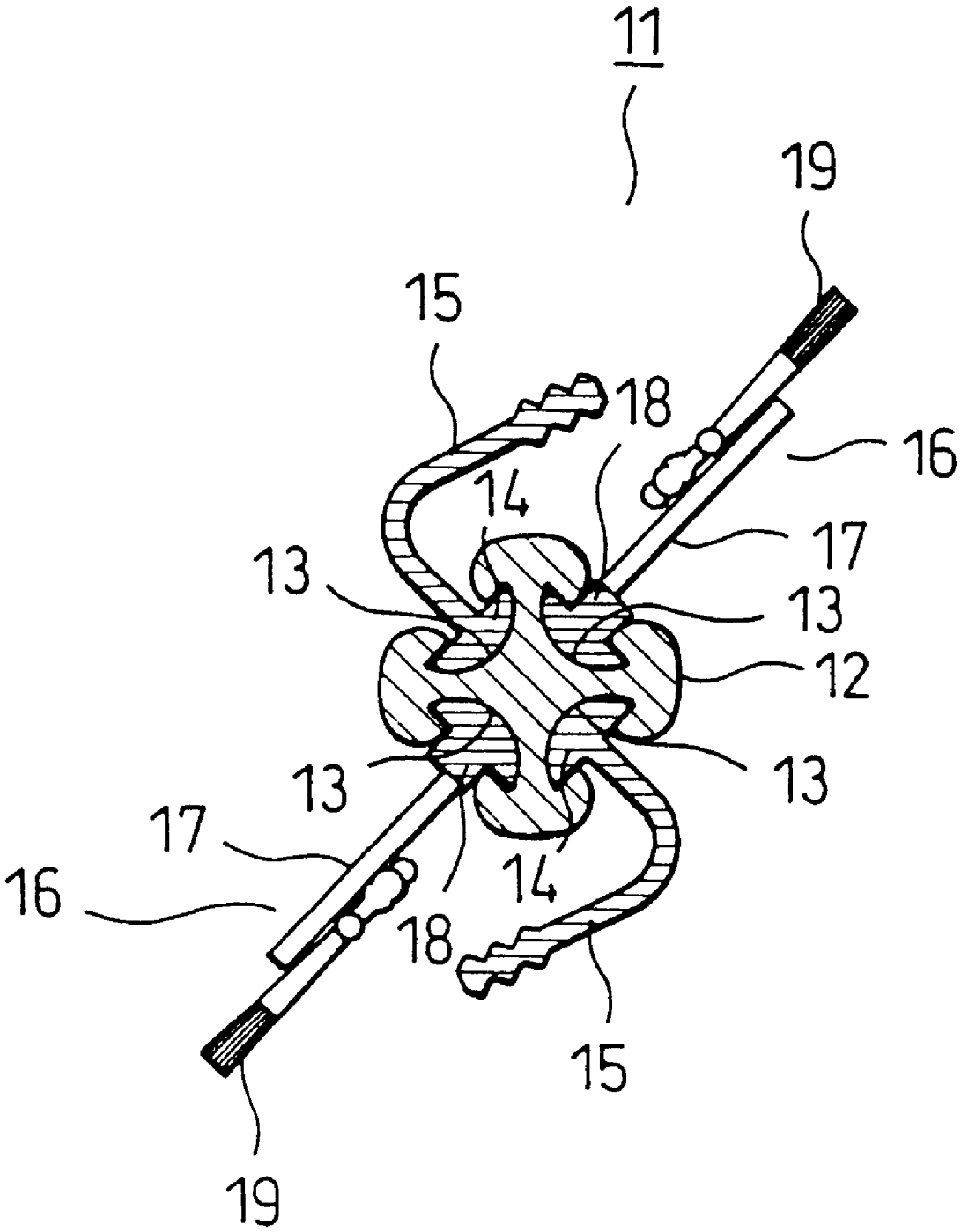
FIG. 10 is a transverse cross section of a still another rotational brush for use in a dust suction head in accordance with the invention.

In the example shown in FIG. 9, the first blades 15 are mounted upright on the shaft while the second blades 16 are bent when the brush 11 is stopped. However, the first blades 15 may alternatively bent and the second blades 16 are upright as shown in FIG. 10. Further, both the first and the second blades 15 and 16 may be bent and inclined on the shaft.

Figure 11:
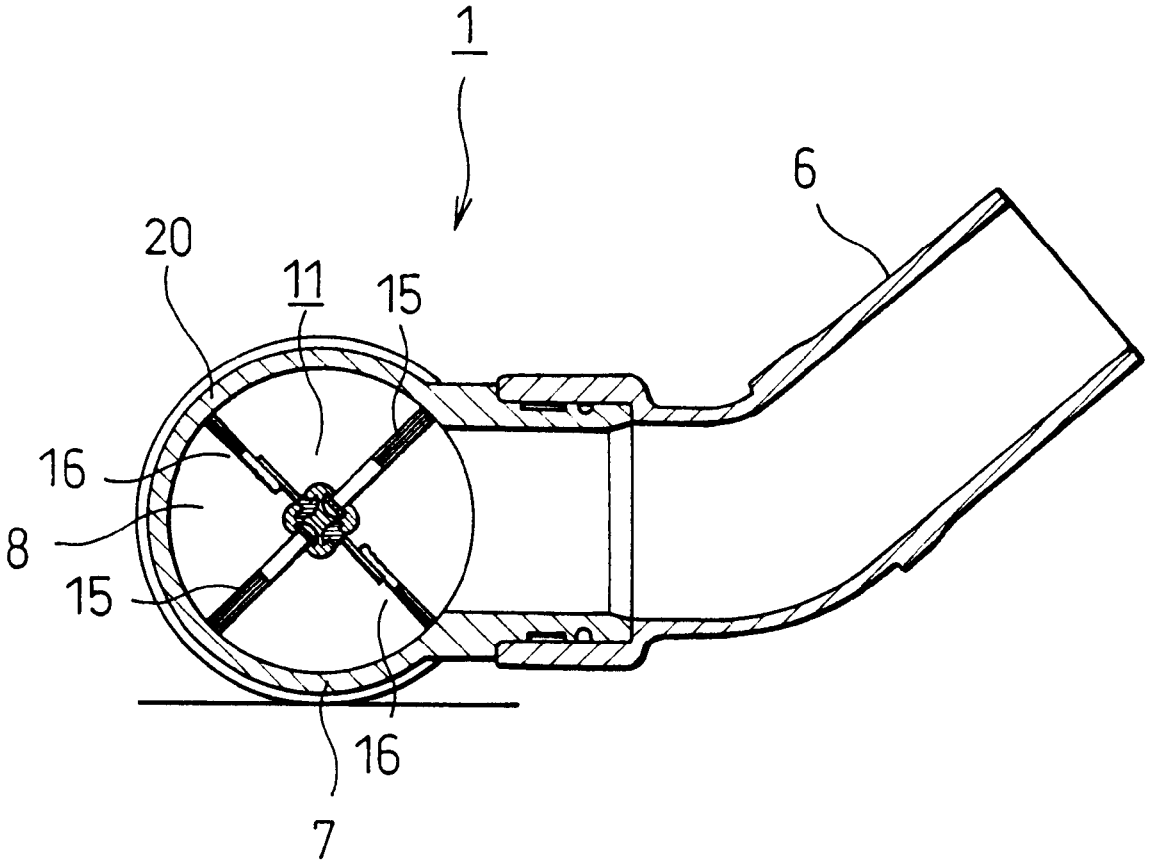
FIG. 11 is a longitudinal cross section of another dust suction head according to the invention.
Figure 12:
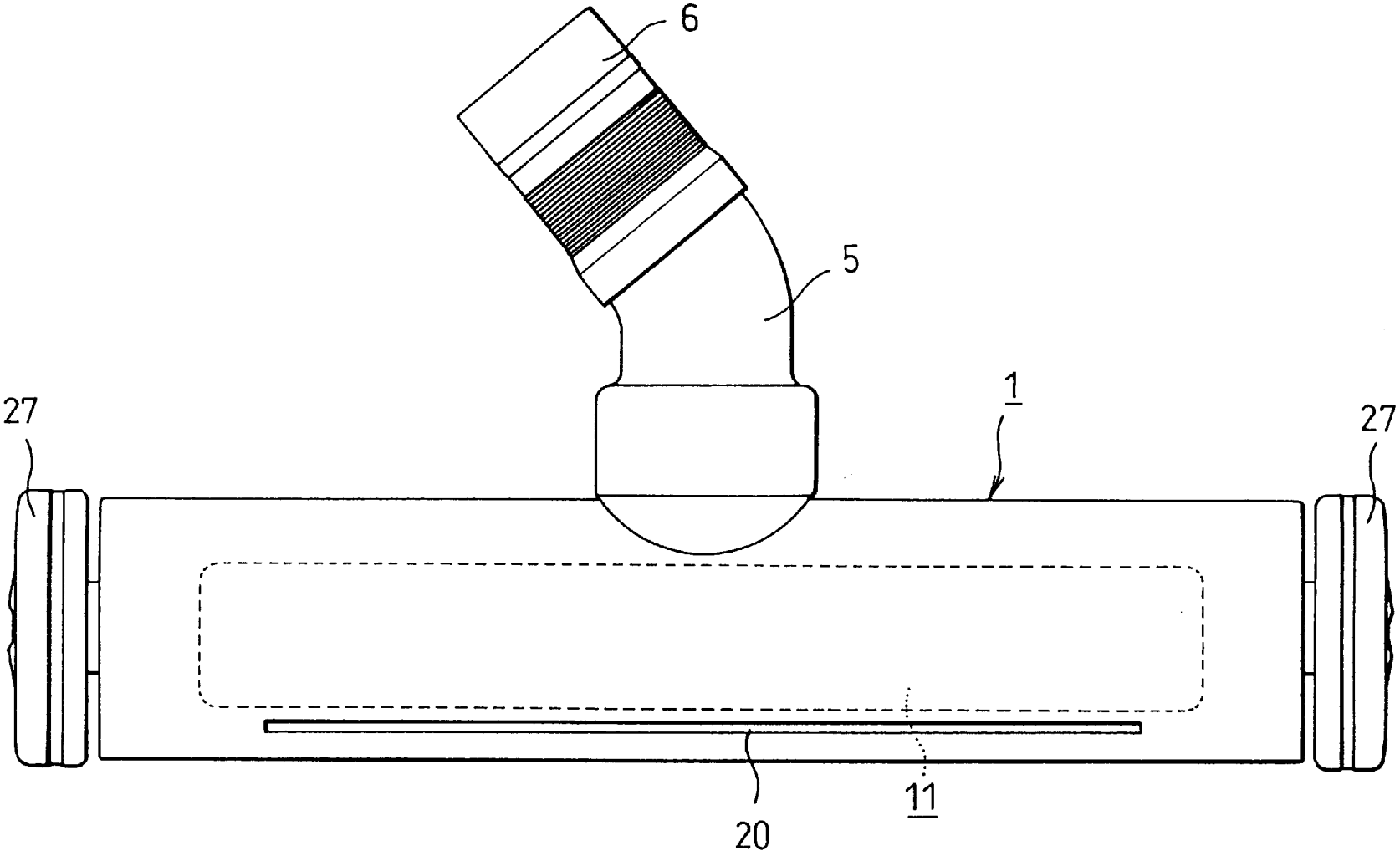
FIG. 12 is a plan view of the dust suction head shown in FIG. 11.

FIGS. 11 and 12 illustrate another example of a dust suction head 1 of the invention. The example shown in FIGS. 11 and 12 differs from the preceding one in that an opening 20 is formed in a case of the dust suction head 1 at a position ahead of the shaft of the rotational brush 11.

In this arrangement, the rotational brush 11 may operate in just the same manner as in the preceding example when the dust suction head 1 is placed on or removed from a flat soft floor such as a carpet. However, in this example, the opening 20 provides fresh air to the front end of the rotational brush 11, so that the air flows in the same direction as the rotational direction of the rotational brush 11 before it is drawn into a connection tube 6, which facilitates efficient rotation of the rotational brush 11.

It would be appreciated that the case of the dust suction head 1 has a simple structure to cover the rotational brush 11 with a case having an inner diameter which is substantially the same as the radii of the blades.

Figure 13:
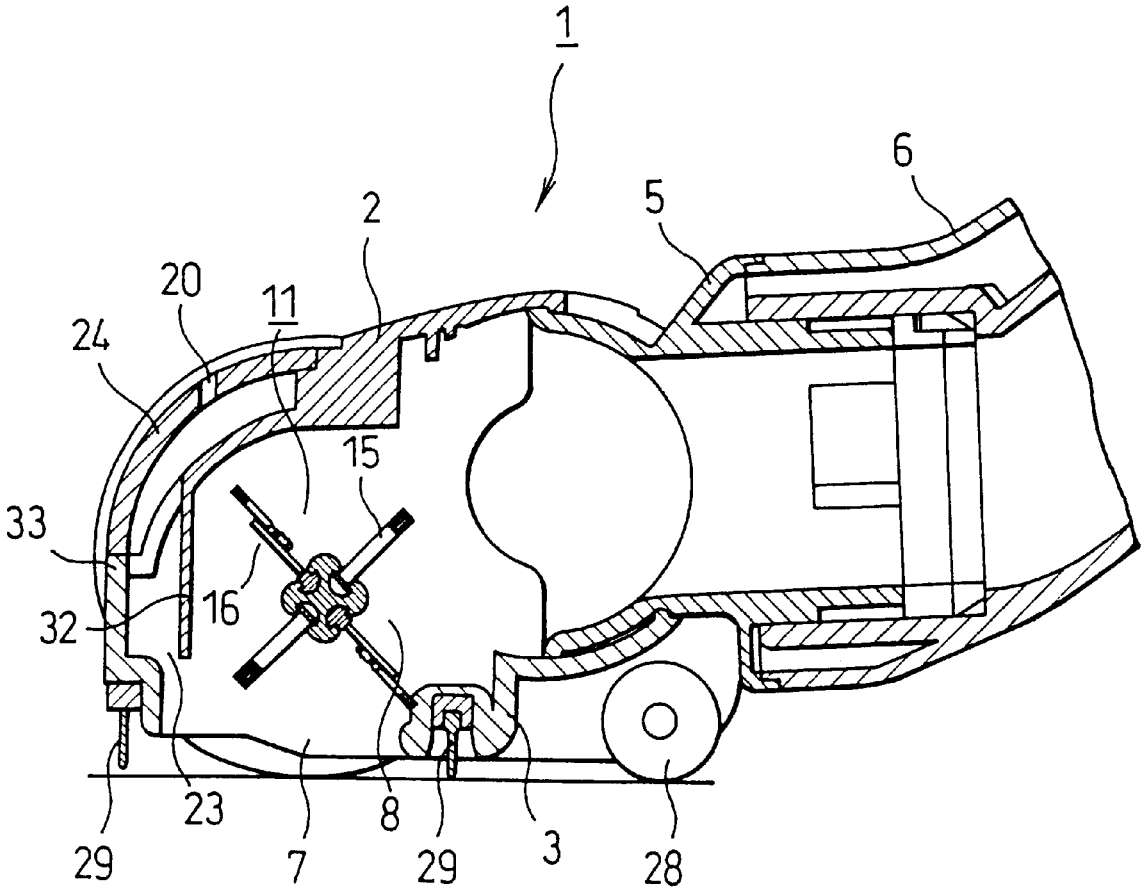
FIG. 13 is a longitudinal cross section of still another dust suction head according to the invention.
Figure 14:
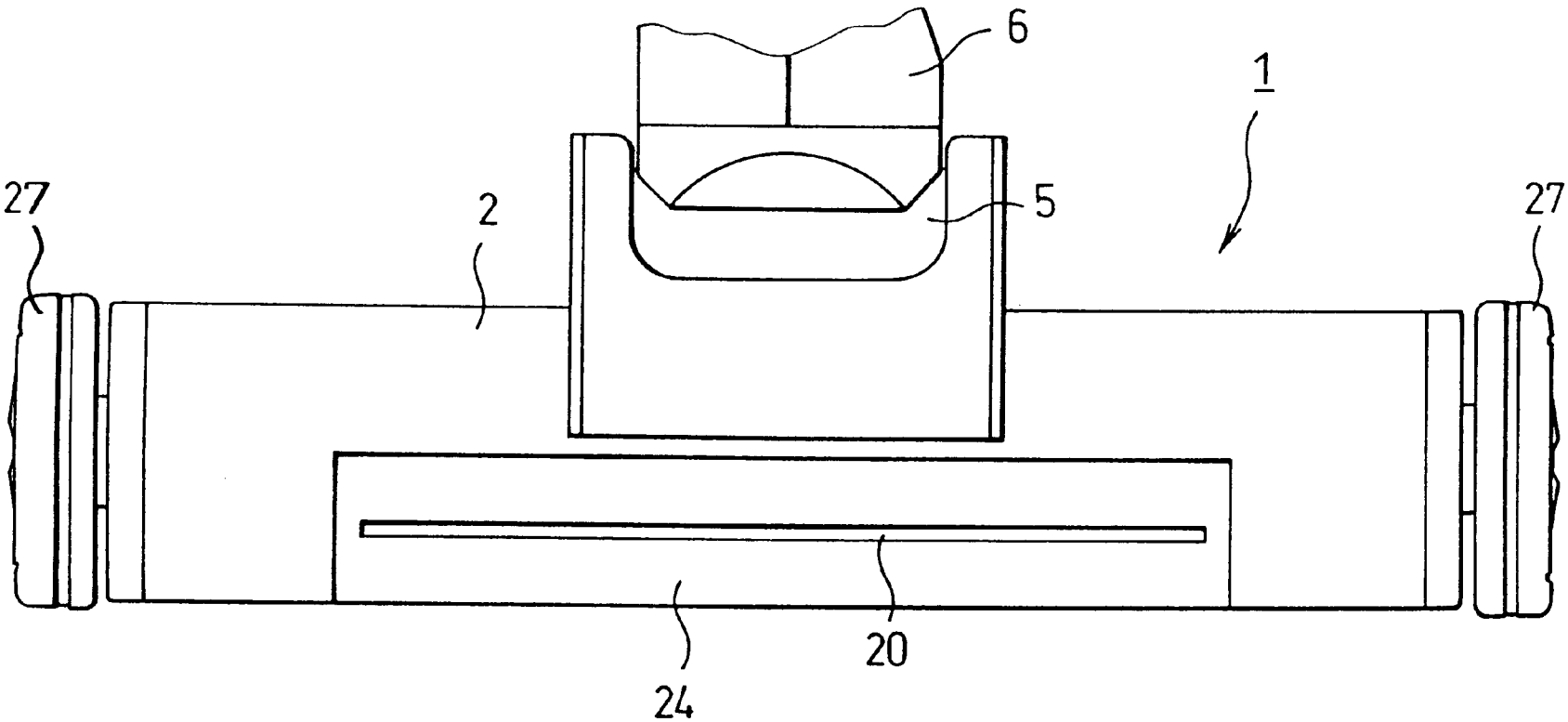
FIG. 14 is a plan view of the dust suction head shown in FIG. 13.

Referring to FIGS. 13 and 14, there is shown a still another example of the invention. The example shown in FIGS. 13 and 14 differs from the aforementioned example in that the upper potion of the case 2 extends below the level of the shaft for the rotational brush 11, and a rib 32 is provided to depend from the cover 2 in front of the rotational brush 11 to allow the fresh air to reach a fresh air induction port 23 between the rib 32 and a front wall 33 of the case 2.

In this arrangement, although the rotational brush 11 operates in the same manner as in the preceding examples, the fresh air entering the brush chamber from the fresh air induction port 23 is allowed to impinge on the floor in front of the rotational brush 11 at a high speed, blowing the dust off the floor, and at the same time driving the blades 15 and 16 in the counterclockwise direction, thereby leading the dust into the connection tube 6.

In this manner, by providing fresh air through the opening 20 and the fresh air induction port 23, the dust suction head 1 is prevented from adhering to the floor if the air suction port 7 is completely covered with a carpet, for example. Furthermore, the fresh air facilitates removal of dust off the floor as described above.

Figure 15:
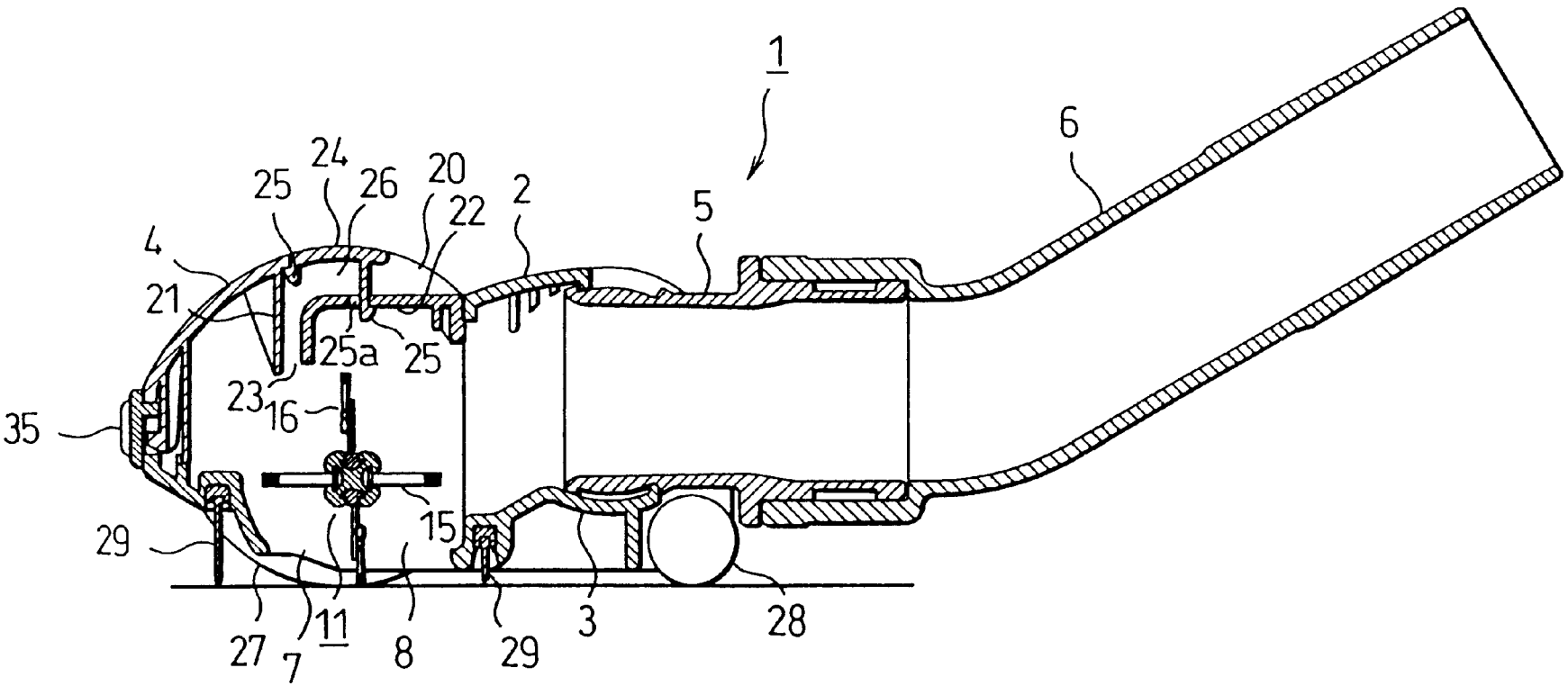
FIG. 15 is a longitudinal cross section of a still another dust suction means according to the invention.
Figure 16:
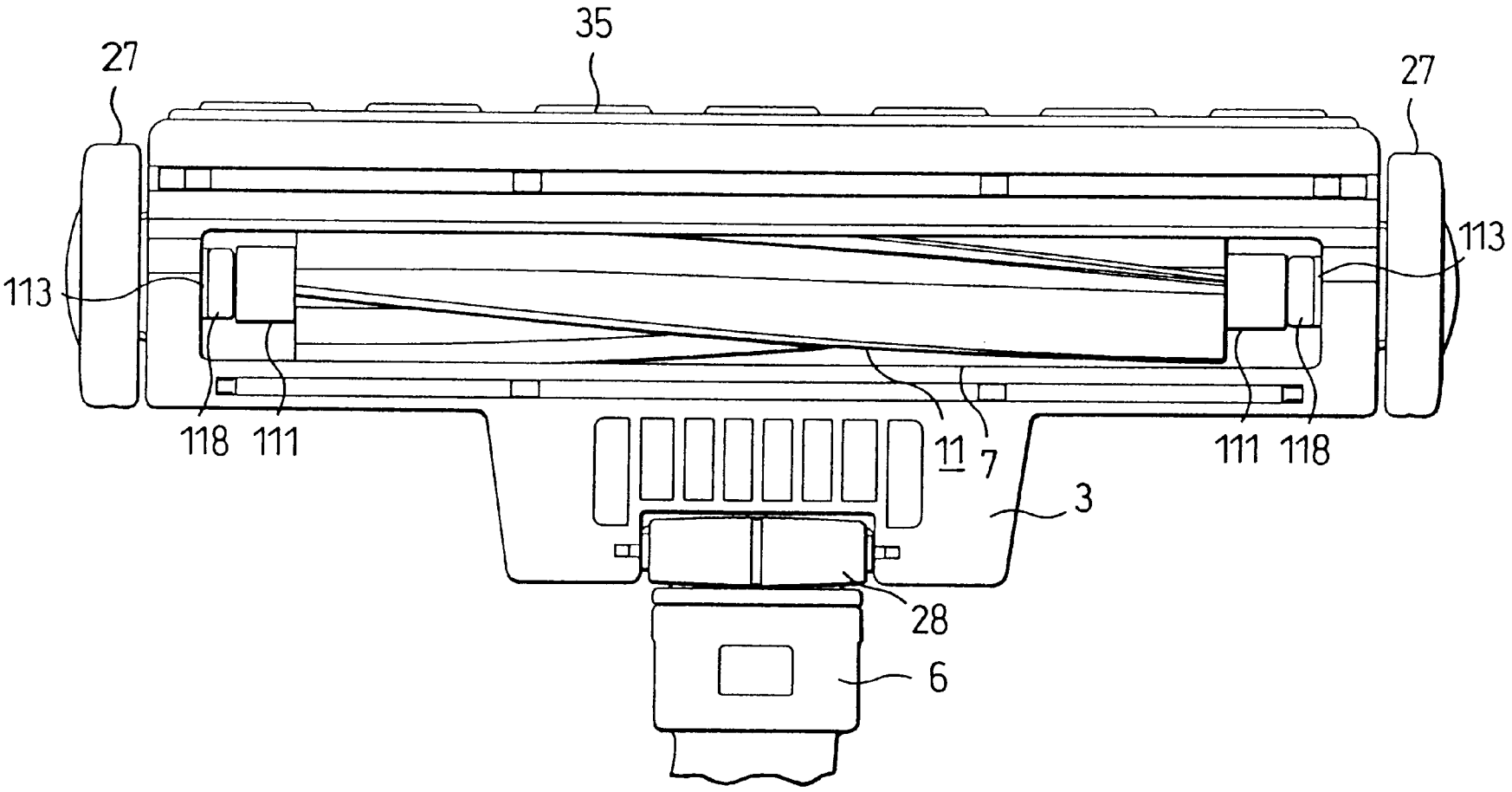
FIG. 16 is a bottom view of the dust suction head shown in FIG. 15.
Figure 17:
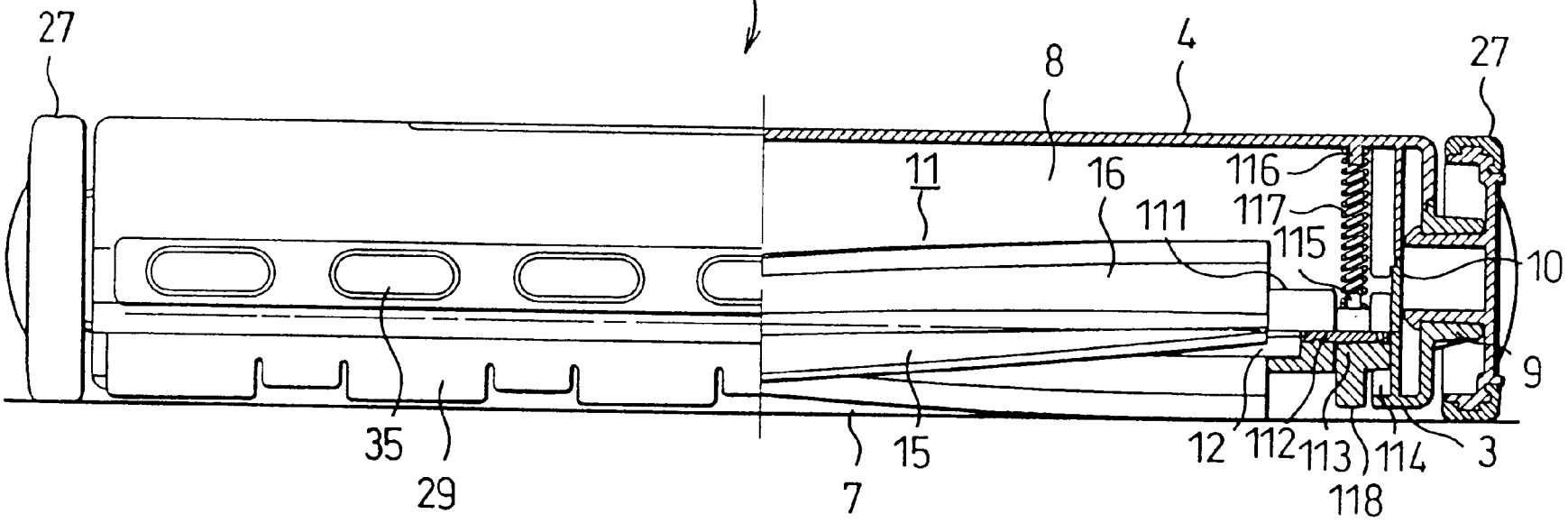
FIG. 17 is a partial cross section of the dust suction head taken on line B—B of FIG. 16.

Referring now to FIGS. 15, 16 and 17, there is shown still another example of the invention.

In FIGS. 15–17, mounted on the front end of the dust suction head 1 is a bumper 35, made of a resilient material such as soft rubber, for protecting furniture and the like and the dust suction head itself from being dented in case the dust suction head bumps against the furniture.

The shaft 12 of the rotational brush 11 is provided at the opposite ends thereof with protruding arbors 112, which are supported by respective bearings 113. The bearings 113 are each mounted in vertical grooves 114 formed in the partitioning ribs 10, so that the rotational brush 11 is allowed to slide vertically.

Each of the bearing 113 has an upward protrusion 115 which opposes a protrusion 116 formed on the back of the lid 4 so as to hold a coil spring 117. The coil springs 117 bias the bearings 113 downward, as shown in FIG. 17. The springs 117 are hard enough to support the weight of the rotational brush 11 and flexible enough to be contracted when they are pushed by protrusions on the floor and adjust the vertical level of the rotational brush 11 in the grooves 114.

Each of the bearings 113 also has a downward protrusion having a length substantially equal to that of the first blades 15. The protrusion has, at the lower end thereof, an abutment face 118 that barely touch the floor when the bearing 113 is forced to the lowest position in the groove 114 by the associated coil spring 117.

FIG. 17 depicts a condition in which the lower end of the protrusion 118 is slightly lifted by plush of a carpet, for example. However, when the dust suction head is placed on a hard flat floor and hence the bearings 113 are lowered to the lowest position, the blades 15 then touch the floor and brush up and/or polish the floor.

The rotational brush 11 shown in the example operates in the same way as the preceding ones. In addition, the bearings 113 are held so that the abutment surfaces 118 are always in touch with the floor. As a result, tips of the first and the second blades 15 and 16 are respectively positioned at the most preferable height for sweeping lint and dust on the floor and at the same time preventing the dust suction head from adhering to the floor. That is, the tips of the blades are kept to lightly touch the floor.

On the other hand, if the floor is carpeted, the abutment surfaces 118 are lifted a little by the plush of the carpet. As a result, the blades are kept at an appropriate depth in the carpet to remove lint and dust therein while preventing the blades 15 and 16 from being caught by excessive friction in the carpet.

Thus, the rotational brush 11 may be held at an optimum height for a particular type floor and may prevent cluttering noise caused by hard vertical vibrations of the rotational brush 11 during its operation, since the bearings 113 are biased downward by the coil springs 117.

It will be understood that the invention is not limited to the coil springs 117 and that it can be replaced by any biasing means such as resilient members mounted in any arbitrary manner.

Figure 18:
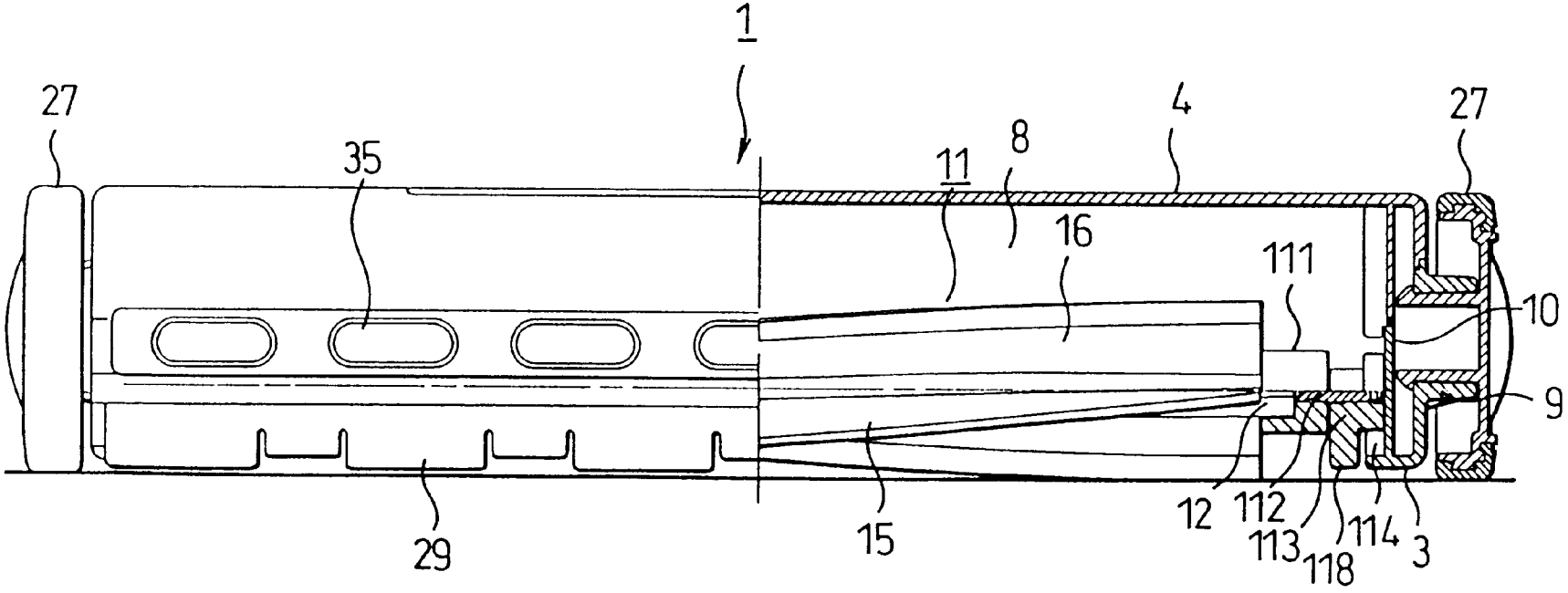
FIG. 18 is a partial cross section taken on line C—C of a front part of the dust suction head of FIG. 16.

Referring now to FIG. 18, there is shown a still another example of the invention. The dust suction head shown in FIGS. 15–17 differs from the preceding ones in that the rotational brush 11 is biased downward by the weight of the rotational brush 11 itself without using coil springs 117 in biasing the bearings 113 of the rotational brush 11.

In this arrangement, the protrusions 115 and 116 and the coil springs 117 are advantageously eliminated so that the dust suction head is simplified in structure and becomes less costly.

It will be noted that the advantages of the preceding examples are also attained in this example. That is, the height of the rotational brush 11 may be appropriately adjusted for a particular type of floor without the coil springs 117, if the weight of the rotational brush 11 is appropriately increased. Therefore, cluttering of the rotational brush 11 due to its irregular vibrations in the groove may be prevented.

Figure 19:
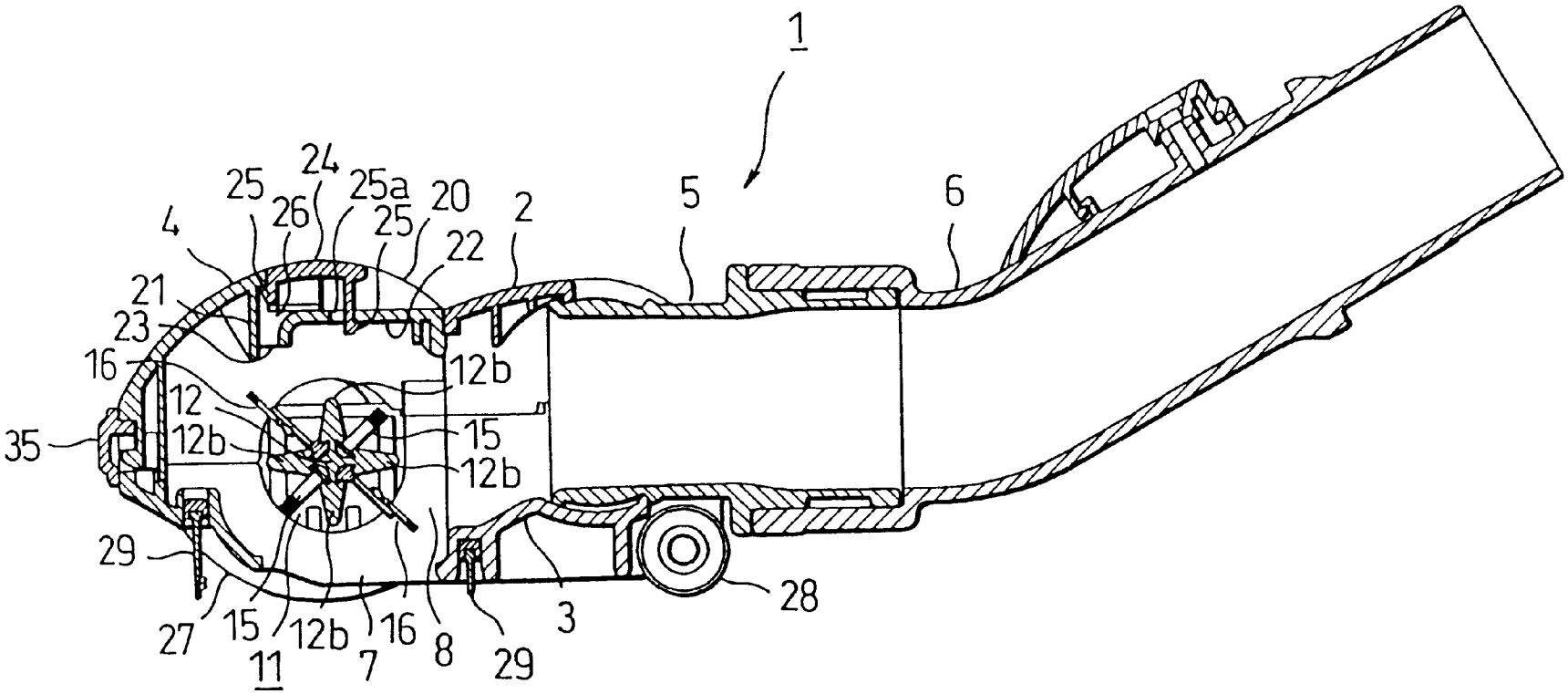
FIG. 19 is a longitudinal cross section of a still another dust suction means according to the invention.
Figure 20A:
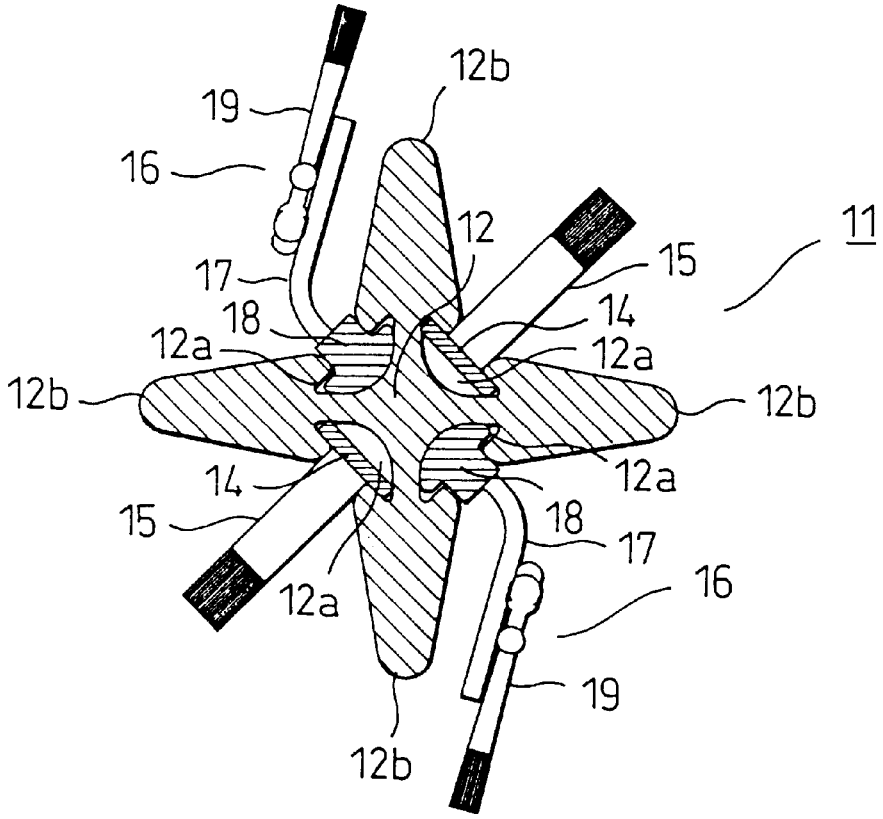
FIG. 20 shows, in detail, the cross section of the rotational brush for use in the dust suction head shown in FIG. 19 at rest (FIG. 20A) and in rotational motion (FIG. 20B).
Figure 20B:
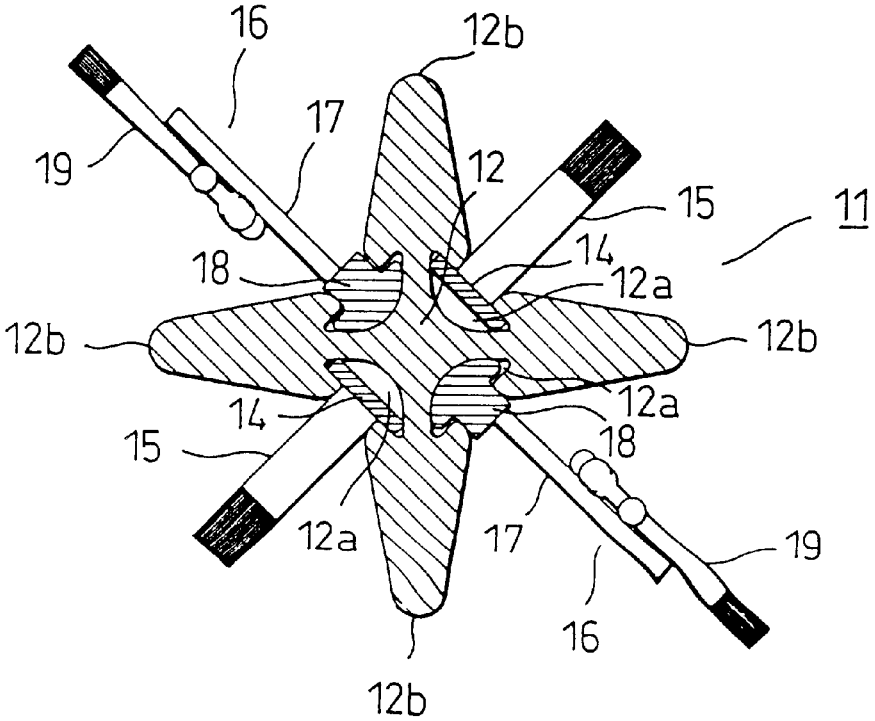

Referring now to FIGS. 19 and 20, there is shown a further example of the invention. In this example, the shaft 12 is provided with four helical rotor blades **12*b* extending between two neighboring blades 15 and 16. These rotor blades 12*b* may be fabricated integral with the shaft 12 when the shaft 12 is fabricated, or fabricated independently of the shaft 12 and later secured in respective four helical grooves formed along the length of the shaft 12. These rotor blades 12*b* are adapted to receive the air flow that impinges on the rotational brush 11 and facilitate the rotation of the brush 11. The shaft 12 is acted on by an extra rotational force by the rotor blades 12*b***.

Thus, the dust suction head 1 may operate in the same way as in the preceding example, but in a more efficient way owing to the rotor blades **12*b* since the rotational blades 12*b*** act as a turbine.

Figure 21:
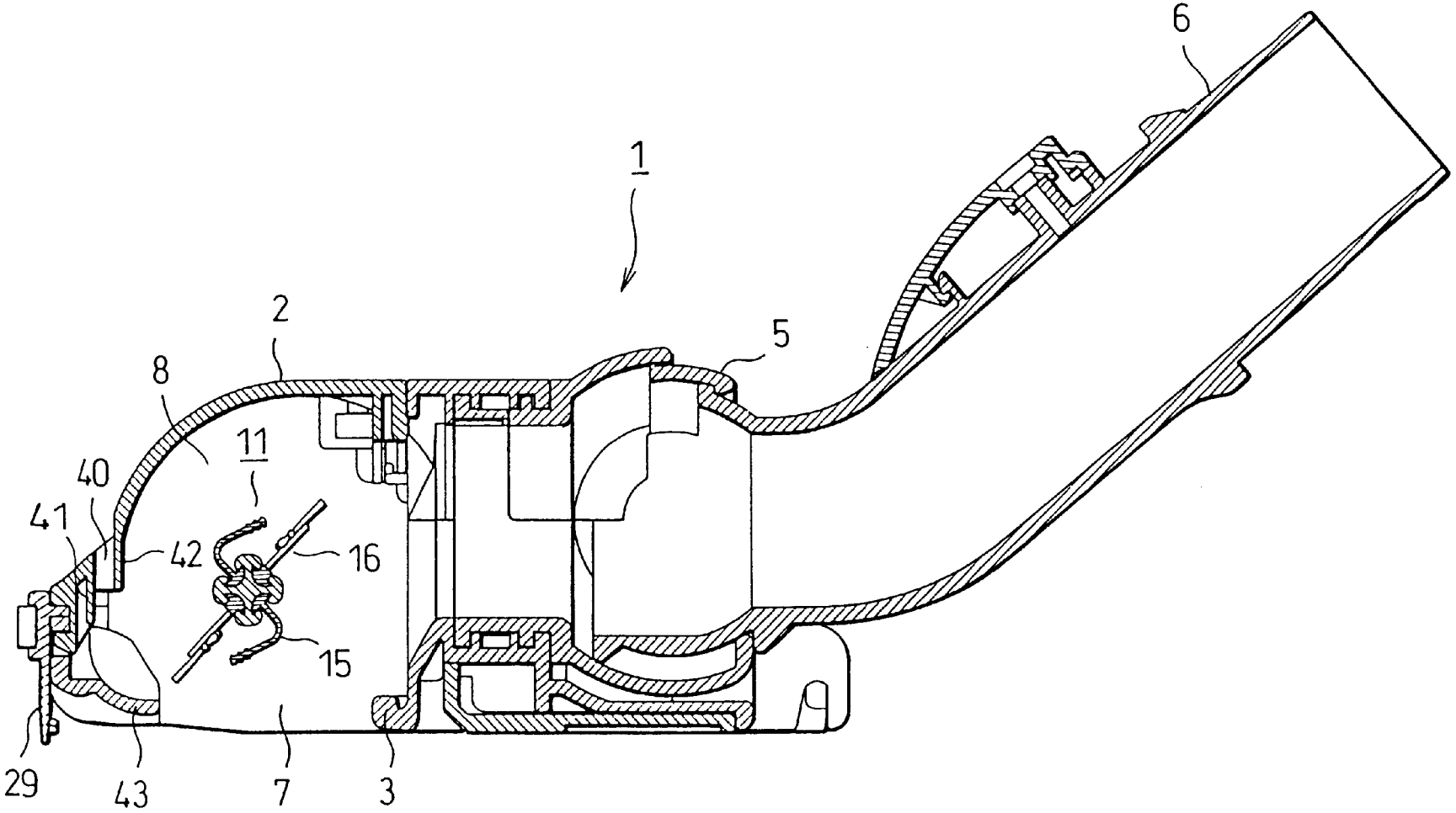
FIG. 21 is a longitudinal cross section of a still another dust suction head according to the invention.
Figure 22:
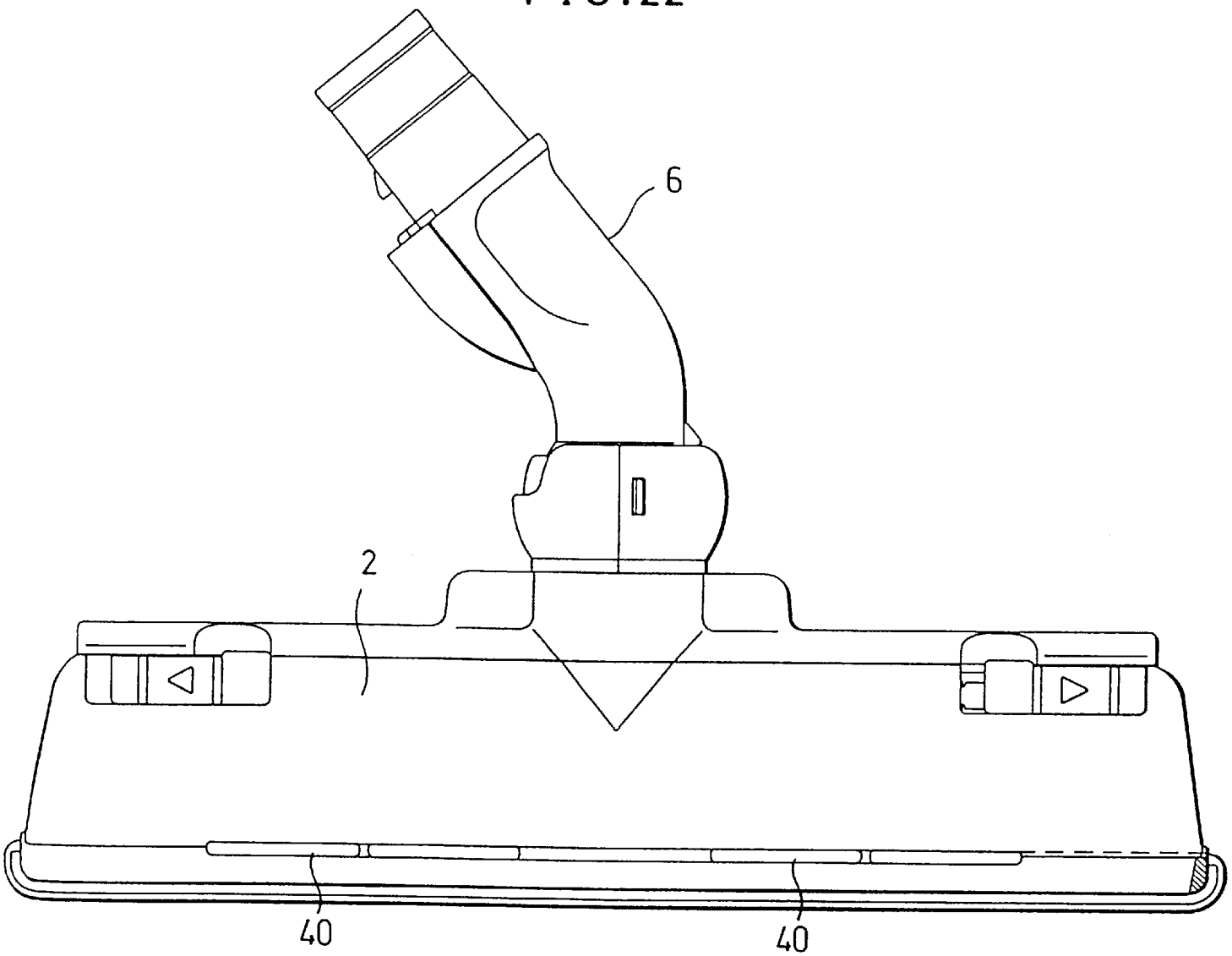
FIG. 22 is a plan view of the dust suction head of FIG. 21.

Referring now to FIGS. 21 and 22, there is shown a still further example of the invention. The example shown herein differs from the previous one in that ribs 41 and 42 are provided at the front end of the upper case 2. The ribs 41 and 42 together forms a nozzle shaped opening 40 for the fresh air. A guide 43 is formed on the lower cover 3, facing the opening 40, so as to lead the fresh air from the opening 40 to the rotational brush 11.

In this example, if the dust suction head 1 is placed on a floor as shown in FIG. 22, the fresh air is guided by the guide 43 from the opening 40 to the blades 15 and 16 depending downward from the shaft 12, thus, providing the rotational brush 11 with a large torque.

Other features of the dust suction head shown in the Figures are the same as those described in conjunction with the preceding Figures.

Figure 23:
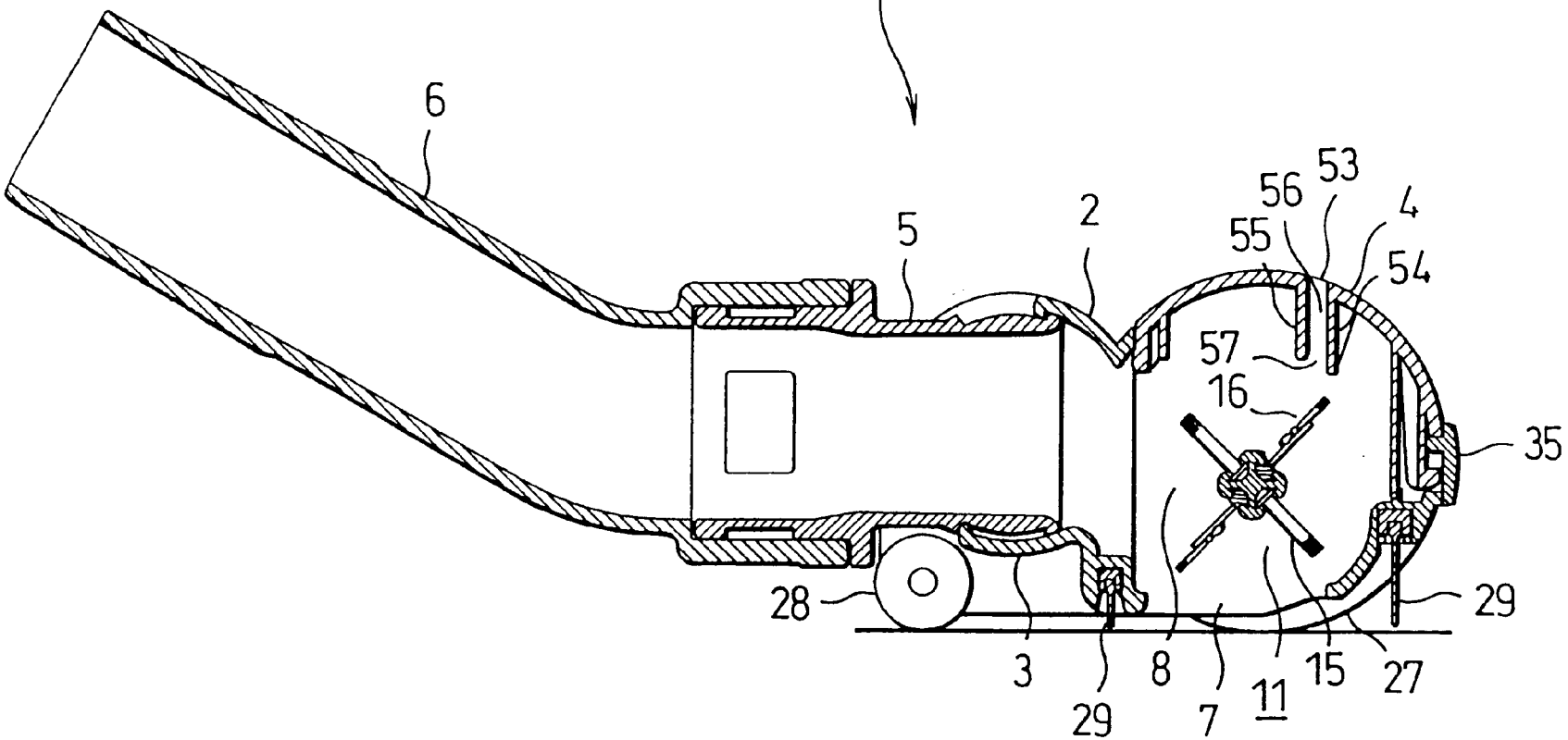
FIG. 23 is a longitudinal cross section of a still another dust suction means according to the invention.
Figure 24:
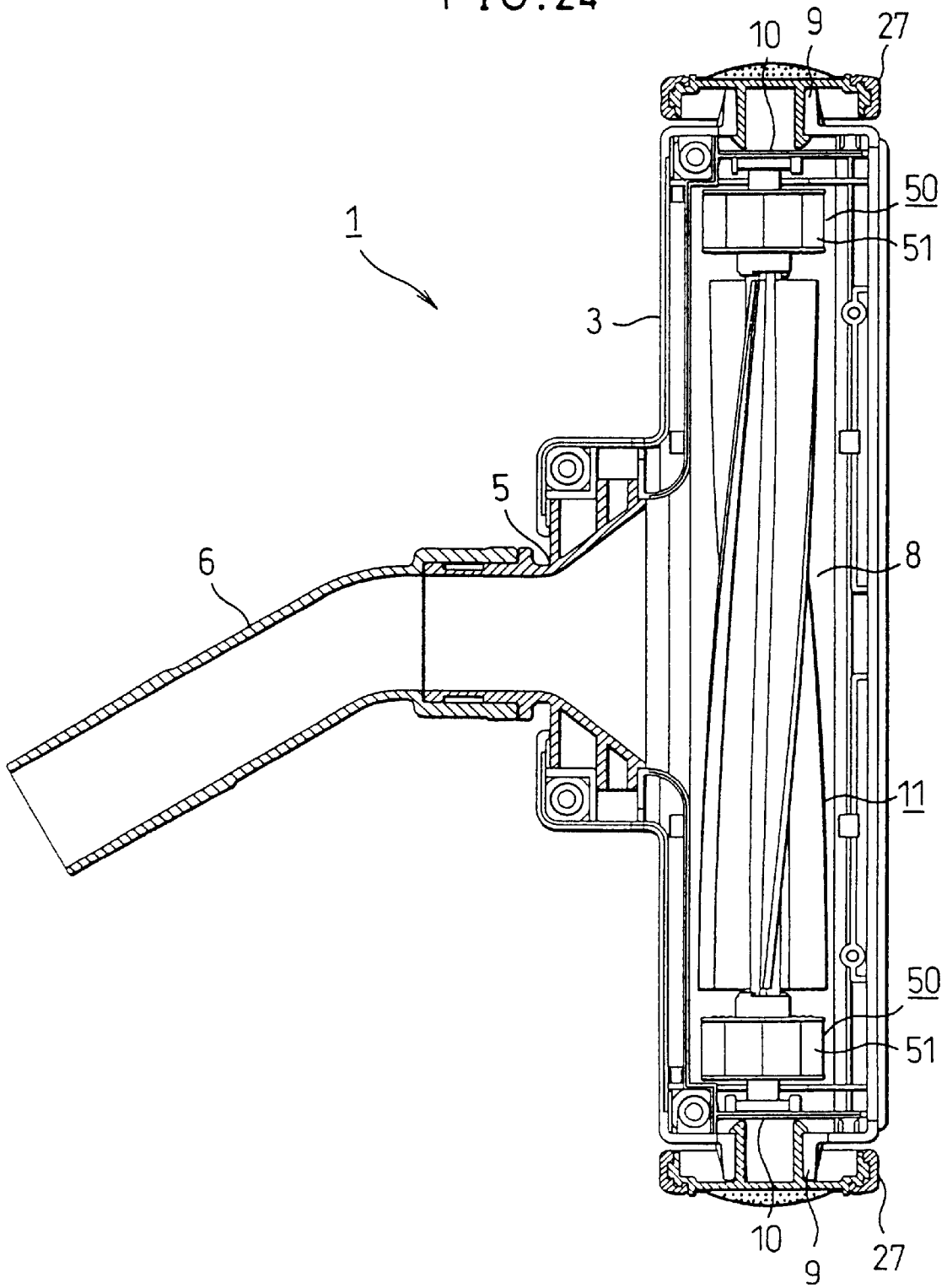
FIG. 24 is a horizontal cross section of the dust suction head of FIG. 23.
Figure 25:
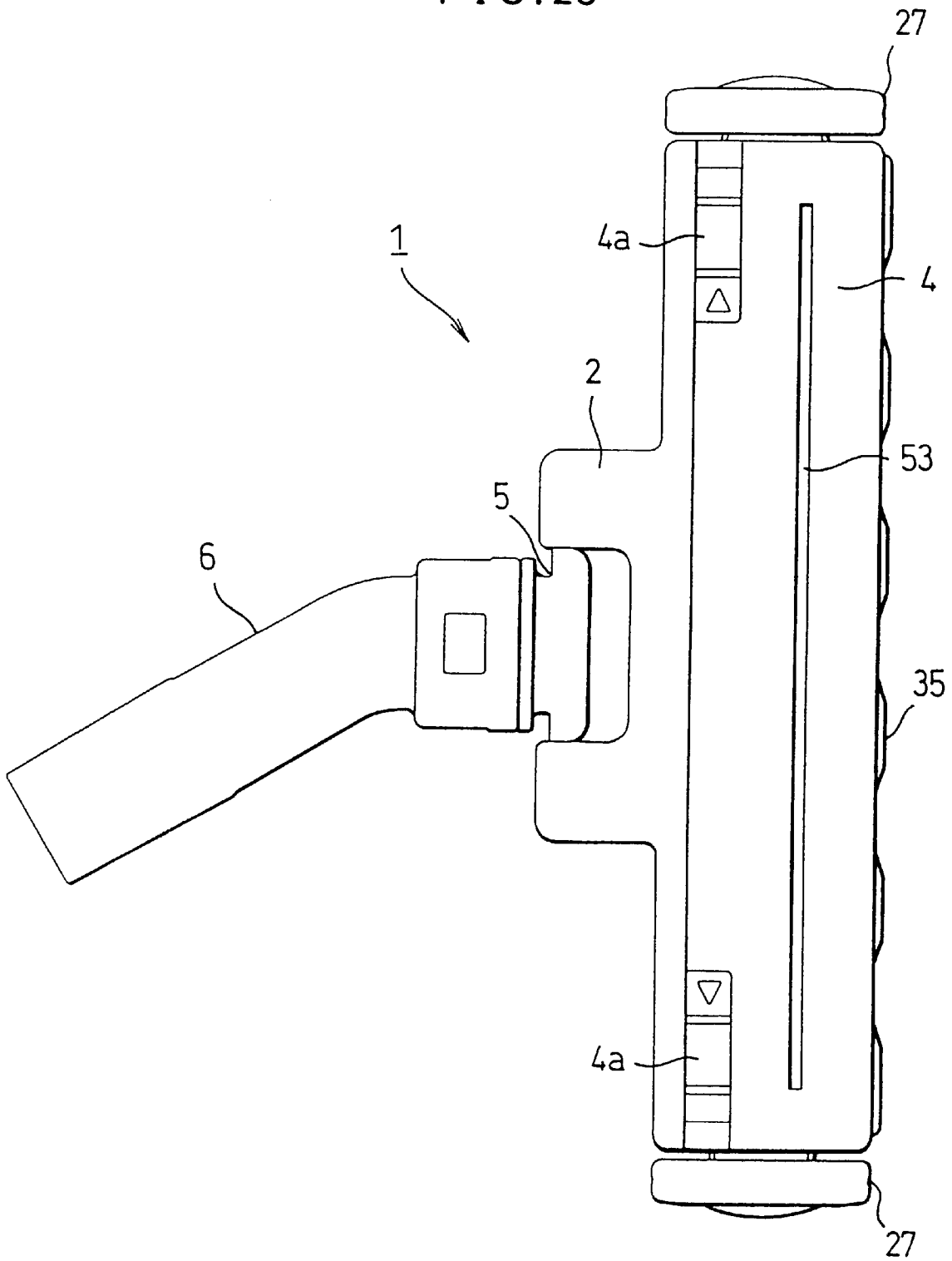
FIG. 25 is a plan view of the dust suction head of FIG. 23.

Referring to FIGS. 23–25, there is shown a still further example of the invention. This example has a feature that a set of turbines 50 are provided on the shaft 12 at the opposite ends of the rotational brush 11, as shown in FIG. 24. The rotor blades 51 of the turbines 50 are designed to receive the fresh air delivered from an air passage 56, as described in more detail later, so as to rotate the brush 11 in the clockwise direction as viewed in FIG. 1.

An elongate slit or opening 53 for taking in the fresh air is formed in the lid 4. The elongate opening 53 extends along substantially the entire length of the rotational brush 11 and the turbines 50. Formed at the front and rear ends of the opening 53 are the first and the second ribs 54 and 55, respectively, forming together an air passage 56 for guiding the fresh air taken in from the elongate opening 53 to the blades 15 and 16 of the brush as well as to the rotor blades 51 of the turbines 50. The ribs 54 and 55 depend downward from the lid 4 to a point which is a little ahead of the shaft 12 and above the locus of the blades 15, 16 and 51.

The lid 4 may be removed from the body by pulling buttons 4*a,* as shown in FIG. 25, for an access to the rotational brush 11 and the turbines 50 for maintenance thereof.

The front wheels 27, mounted on a front shaft support 9, have substantially the same radius as the substantially round body of the dust suction head 1. Mounted at the rear end of the dust suction head 1 are rear wheels 28 having a smaller diameter.

A connection tube 6 is connected with the dust suction head 1 via a flexible hose and an extension tube. When the dust suction head 1 is placed on a floor, the vacuum cleaner operates substantially in the same manner as in the previously described examples.

When cleaning a soft floor such as a carpet, the air suction port 7 is covered with the floor, which increases air friction through the air suction port 7, which in turn increases the amount of fresh air taken in from the air passage 56 of the upper lid 4. Since the air induction port 57 has a much smaller aperture than the air suction port 7, the fresh air from the fresh air induction port 57 acquires a much higher fluid velocity than through the air suction port 7 and impinged with that speed on the rotational rotor blades 51 of the turbine 50 as well as to the blades 15 and 16, driving them to move in the clockwise direction as seen in FIG. 1. The blades 15 and 16 and the rotational brush 11 are accelerated by the force acting thereon, in addition to a rotational force acting on the turbine 50. Thus, the rotational brush acquires a desirable rotational force necessary for cleaning a soft, frictional floor.

Since the first rib 54 is arranged to depend downwardly from the front end of the fresh air induction port 57 as described above, it prevents the fresh air from escaping out into a front space ahead of the rotational brush 11 and guides the fresh air directly onto the blades 15 and 16, thereby facilitating the rotation of the brush 11.

Similarly, since the second rib 55 depends from the rear end of the fresh air induction port 57 as described above, it prevents the fresh air from escaping out into a space above the rotational brush 11 without interacting therewith and guides the fresh air directly onto the blades 15 and 16, thereby, facilitating the rotation of the brush 11.

It is noted that the brush chamber 8 has a substantially cylindrical cross section to prevent the fresh air impinging on the blade 15 and 16 from diverging away therefrom, thereby facilitating continuous rotation of the brush 11.

The air passage 56 extends over the length of the turbine 50 on the opposite ends of the rotational brush 11, so that no extra air suction port is necessary for the turbine 50. This is an advantage in manufacturing the dust suction head 1 at low cost.

Since the air passage 56 is provided in the top end of the body 1, it is not blocked by a wall while cleaning the floor close to the wall, so that a rotational force on the blades 15 and 16 of the rotational brush 11 is always available.

As an ancillary aspect of the invention, fresh air from the air passage 56 may prevent the head 1 from excessively adhering to the floor, and hence, improve mobility of the body 1.

As in the previous example, the rotational brush 11 of this example may also be stretched or bent smoothly even when the rotational speed of the rotational brush 11 fluctuates.

Figure 26:
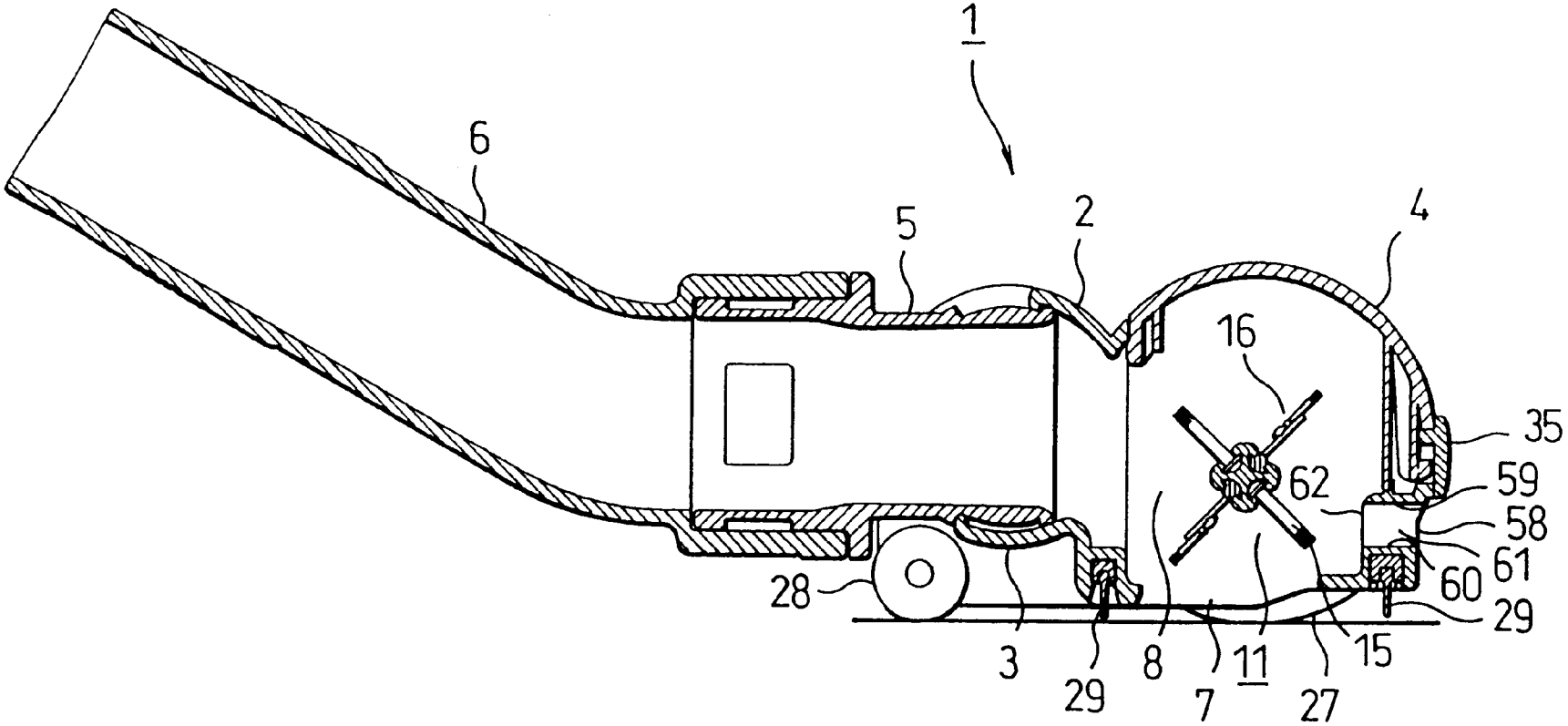
FIG. 26 is a longitudinal cross section of a still another dust suction means according to the invention.
Figure 27:
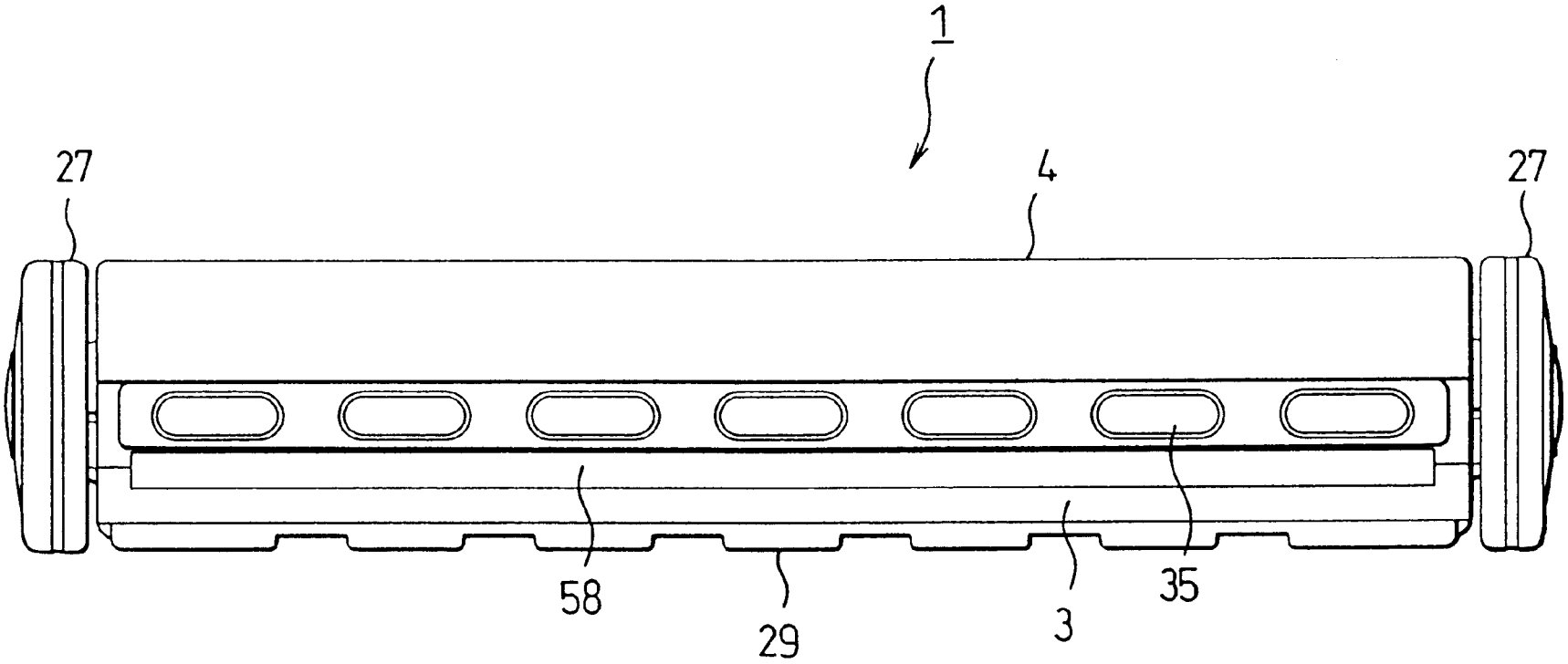
FIG. 27 is a front view of the dust suction head of FIG. 26.
Figure 28:
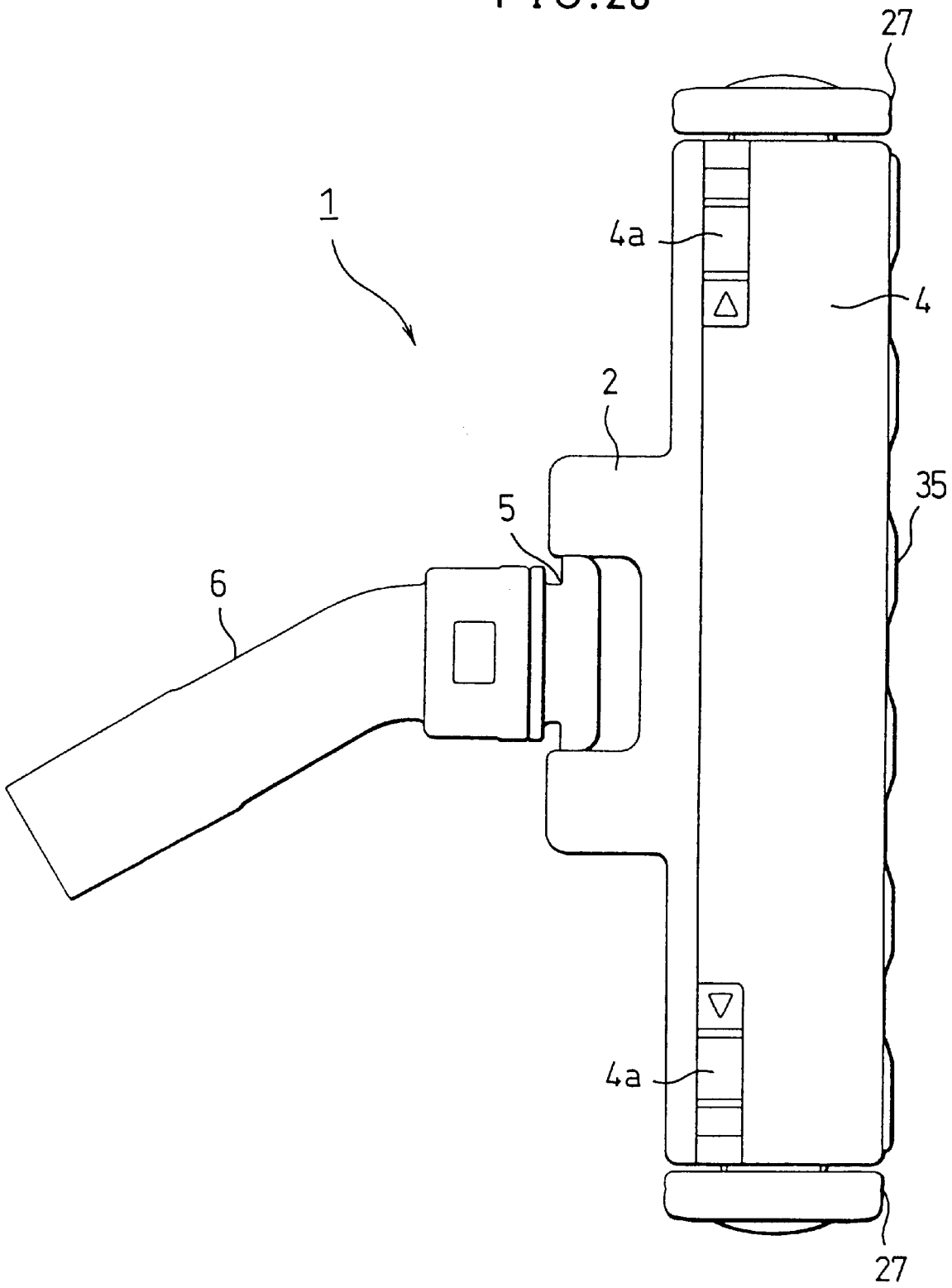
FIG. 28 is a plan view of the dust suction head of FIG. 26.

FIGS. 26 through 28 show another example. In this example, an opening 58 is formed on the front end of the body 1, in contrast to the previous examples in which the opening 53 is formed in the top section of the lid 4. In particular, the opening 58 can be a slit having substantially the same length as the rotational brush 11 plus the turbine 50, and is formed in the front end of the lower case 3 below the bumper 35.

The lower case 3 has a thick wall section at its front end. An upper wall 59 and an bottom wall 60 extend from the front opening 58 in substantially parallel relationship towards the inside thereof. A fresh air induction port 62 is formed inside the brush chamber 8. The upper wall 59 and the bottom wall 60 correspond to the first rib 54 and the second rib 55 of the preceding example. They guide the fresh air taken in from the air passage 61 to the front of the rotational brush 11 and then onto the lower blades 15 and 16 of the rotational brush 11.

The advantages discussed in the preceding example may be obtained with this dust suction head 1. In particular, when the fresh air from the air passage 61 impinges on the blades 15 and 16 which are in contact with the floor such as a carpet, the air forces the blades in the rotational direction, thereby preventing loss of rotational speed of the rotational brush 11.

It would be understood that the projecting bumper 35 ensures suction of air through the opening 58 while cleaning the floor adjacent a wall if the opening 58 is formed in the front end of the lid 4 as described above.

Figure 29:
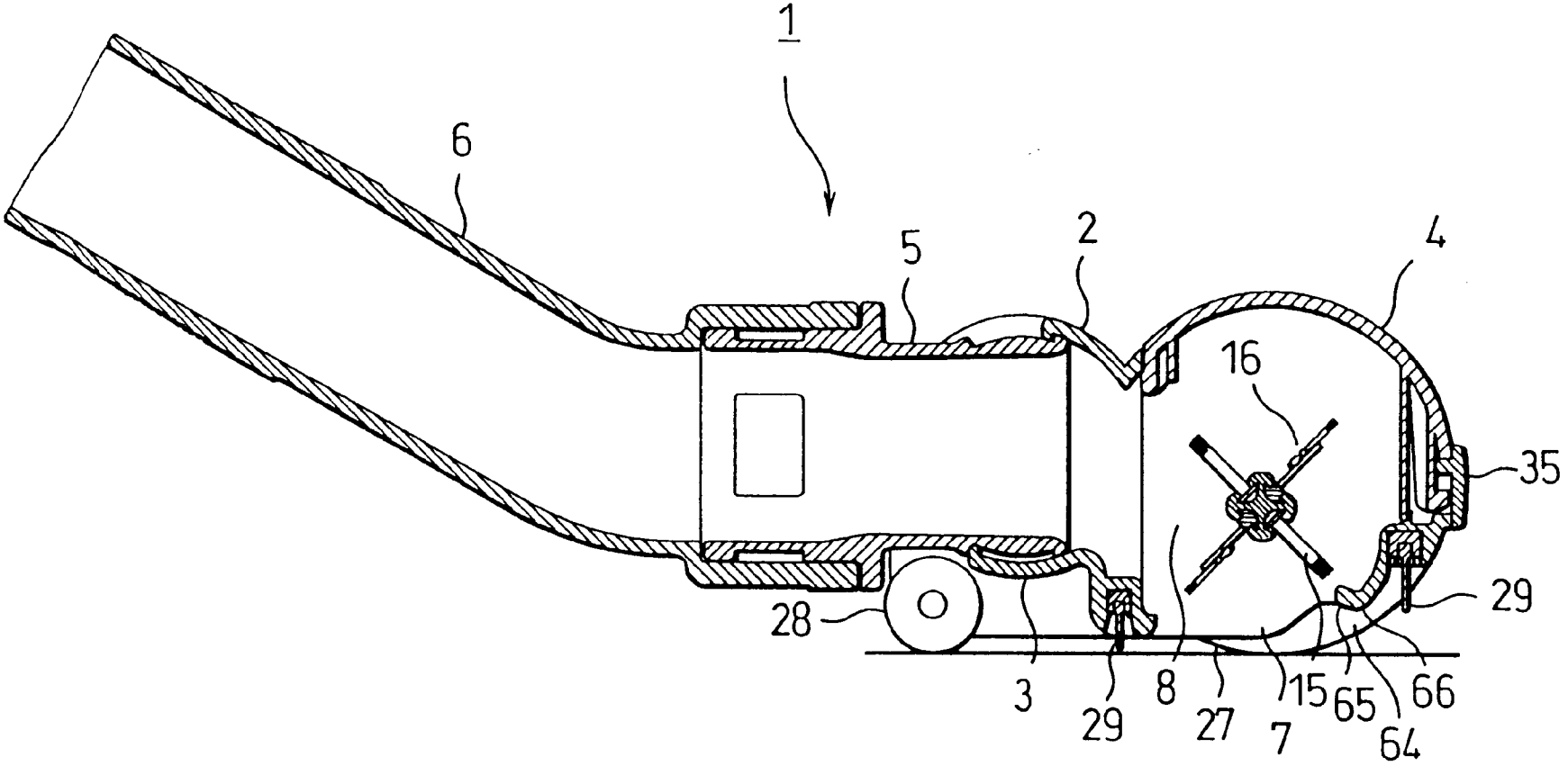
FIG. 29 is a longitudinal cross section of a still another dust suction head according to the invention.
Figure 30:
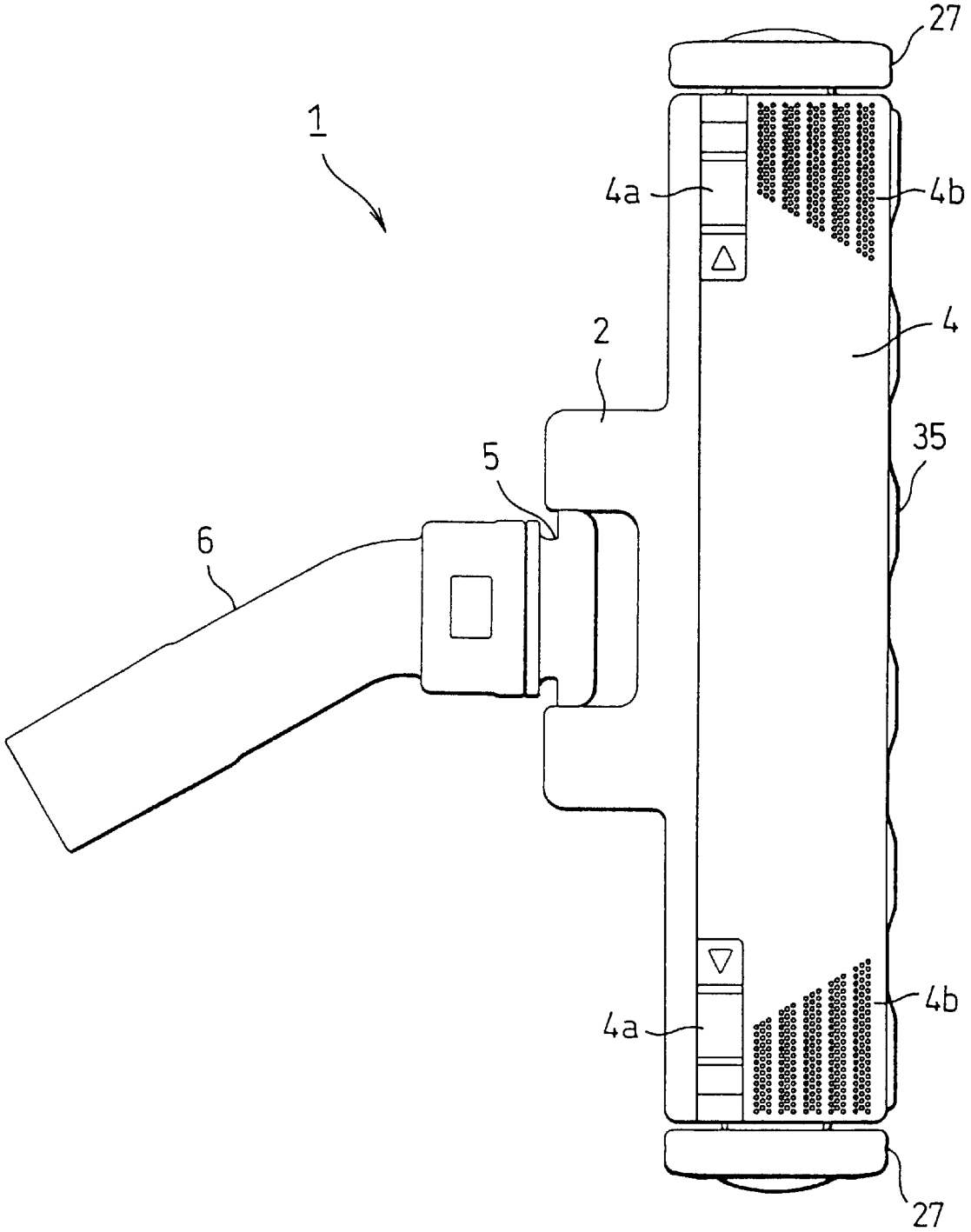
FIG. 30 is a plan view of the dust suction head of FIG. 29.
Figure 31:
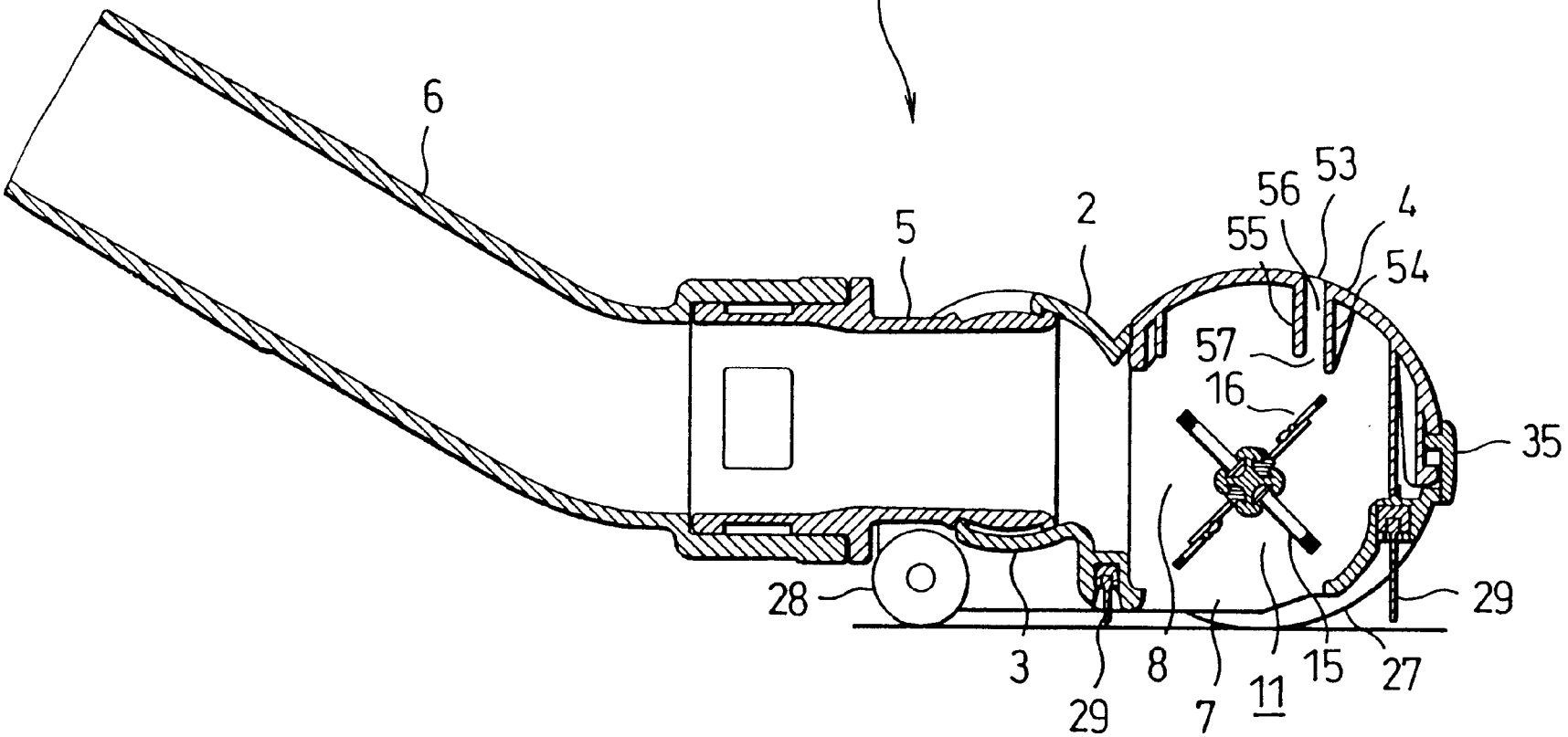
FIG. 31 is cross section of a still another dust suction head according to the invention.

FIGS. 29 through 30 show a still further example of the invention.

In this example, no air suction port is provided, but an air passage 64 is formed under the lower front end of the head 1 in the form of a wide gap such that the gap is not blocked by long plush of a carpet, for example, even when the head 1 is placed on the carpet. A guide is formed at the front edge of the air suction port 7 for guiding the air sucked from the front gap (air passage 64) to the lower blades 15 and 16.

Specifically, the air suction port 7 is formed with its front edge 65 shorter than the rear edge of the air suction port 7 and with the tip of the front edge 65 pointing to a lower section of the rotational brush 11. As a result, the lower front end 66 of the lower case 3 is positioned at a higher level than those of conventional ones, so that a gap (air passage 64) is always formed by the front edge 65 and an air guide is formed under the curved front end 66 for leading the air to the lower blades 15 and 16 even when the dust suction head 1 is placed on a carpet having long plush.

In the example shown here, perforated openings 4*b* for a turbine 50 (FIG. 30) are provided on the opposite ends of the rotational brush 11 in order to take advantage of the air guide formed at the front end of the air suction port 7. Formed on the back of these perforated openings 4*b* are air guides (not shown) for guiding fresh air onto the rotor blades 51 of the turbine 50 (forward).

In this arrangement of the body 1, the same effect may be obtained as in the preceding examples. In particular, fresh air taken in from the air passage 64 impinges on the blades 15 and 16 which are in contact with the floor such as a carpet. The air forces the blades to rotate in the forward direction (i.e. natural rotational direction of the blades), thereby effectively preventing loss of rotational speed of the brush 11 that can arise from the friction of the carpet.

It is noted that this design requires no opening in the body 1, so that the head 1 may be manufactured at a lower cost. In addition, the openings 4*b* provides fresh air for efficient acceleration of the turbine 50 and hence the rotational brush 11.

FIGS. 31 through 35 show a still further example of the invention.

Figure 34:
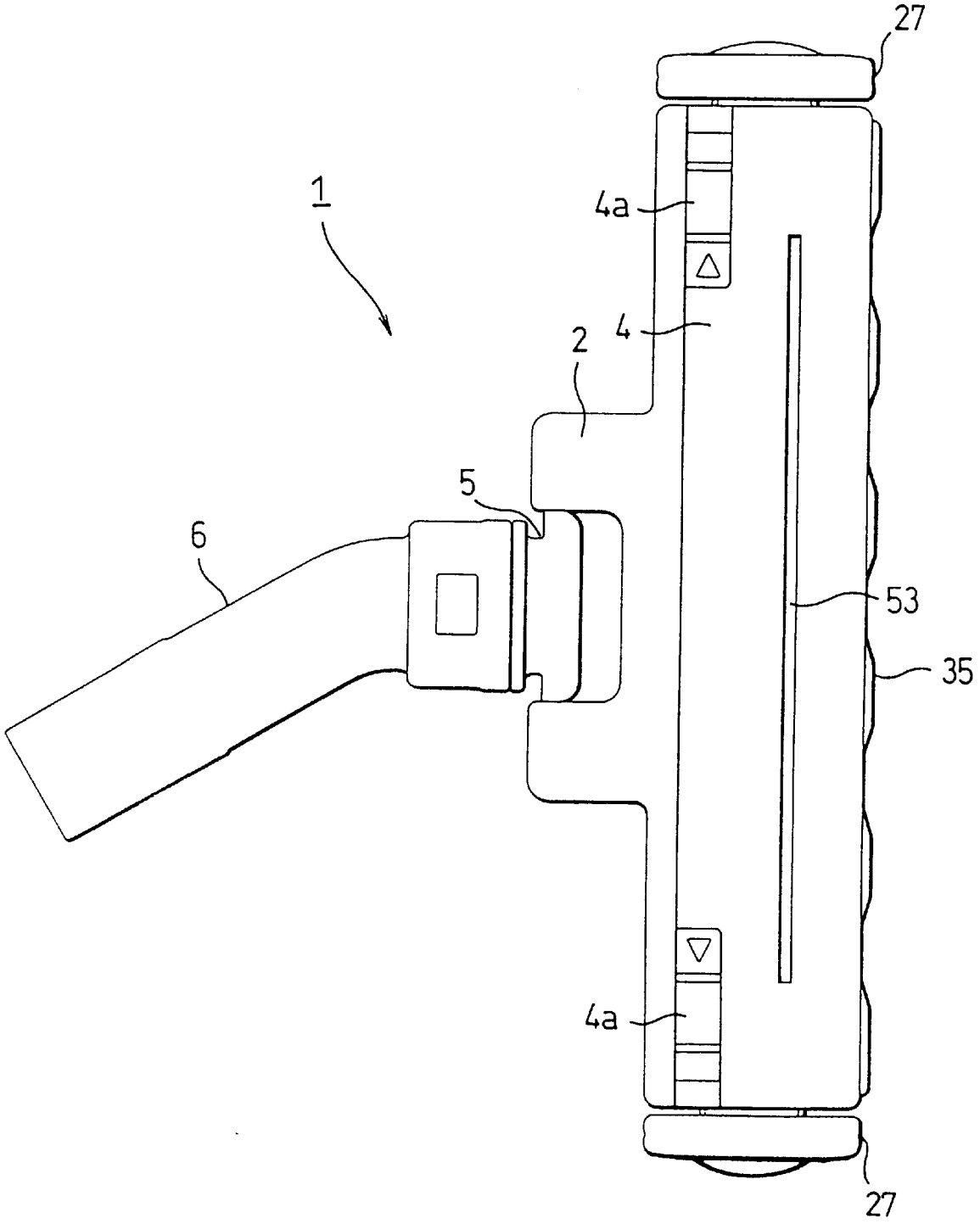
FIG. 34 is a plan view of the dust suction head of FIG. 31.

This example is similar to the preceding one shown in FIG. 23 in that an opening 53 is formed in the upper lid 4 and depending ribs 54 and 55 formed at the front and the rear ends of the opening 53, respectively. The ribs 54 and 55 together form an fresh air induction port 57 for guiding fresh air from the air passage 56 into the brush chamber 8. But this example differs from the preceding one in that the opening 53 has only a limited length which is equal to the length of the rotational brush 11 as shown in FIG. 34.

In this example, an extra opening 53 is provided on both sides of the body 1, instead of forming an elongate opening along the entire length of the rotational brush 11 and the turbine 50 or providing an opening 4*b* at the upper front ends of the lid 4 as in the previous example.

Figure 32:
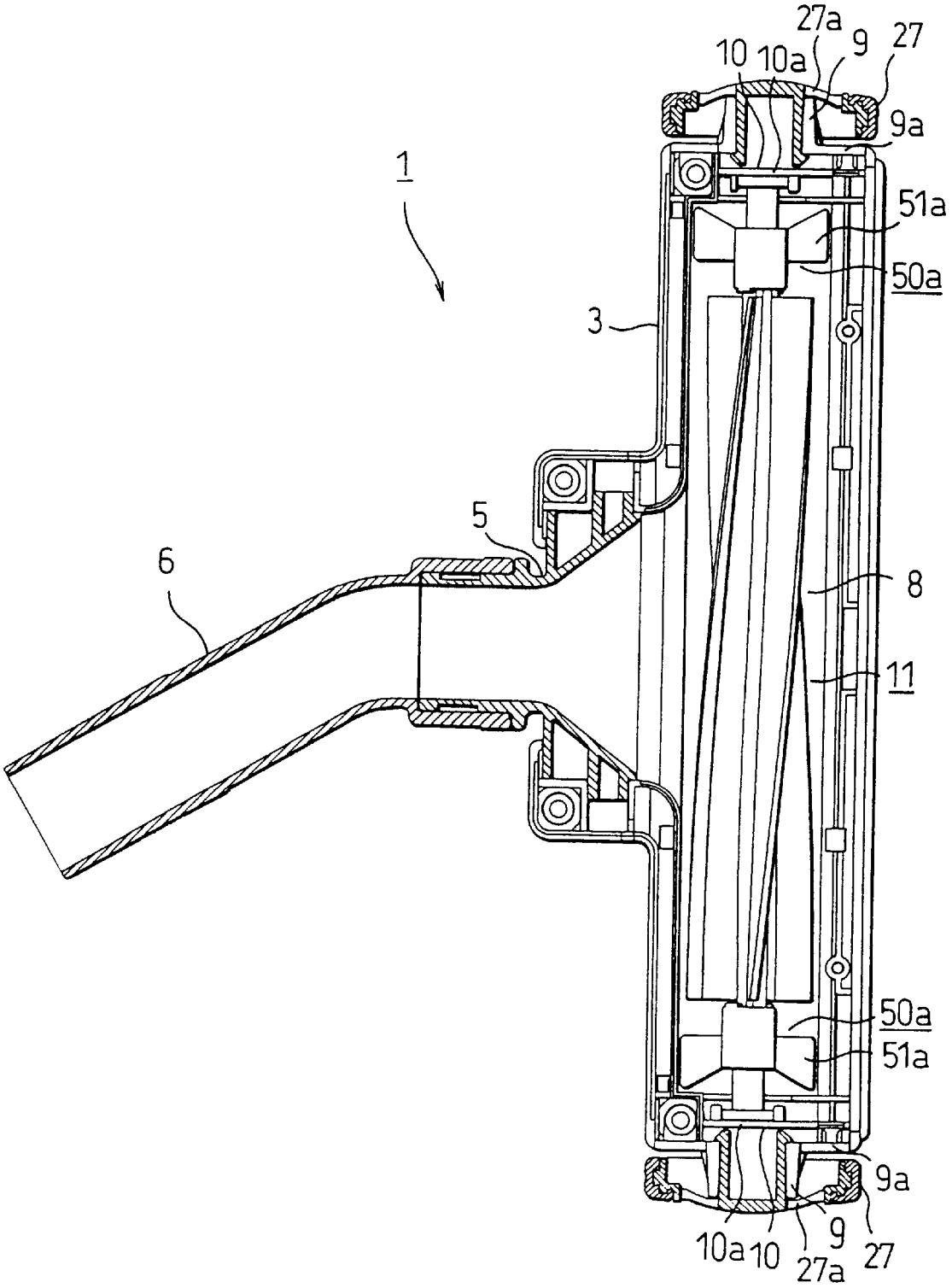
FIG. 32 is a horizontal cross section of the dust suction head of FIG. 31.
Figure 35:
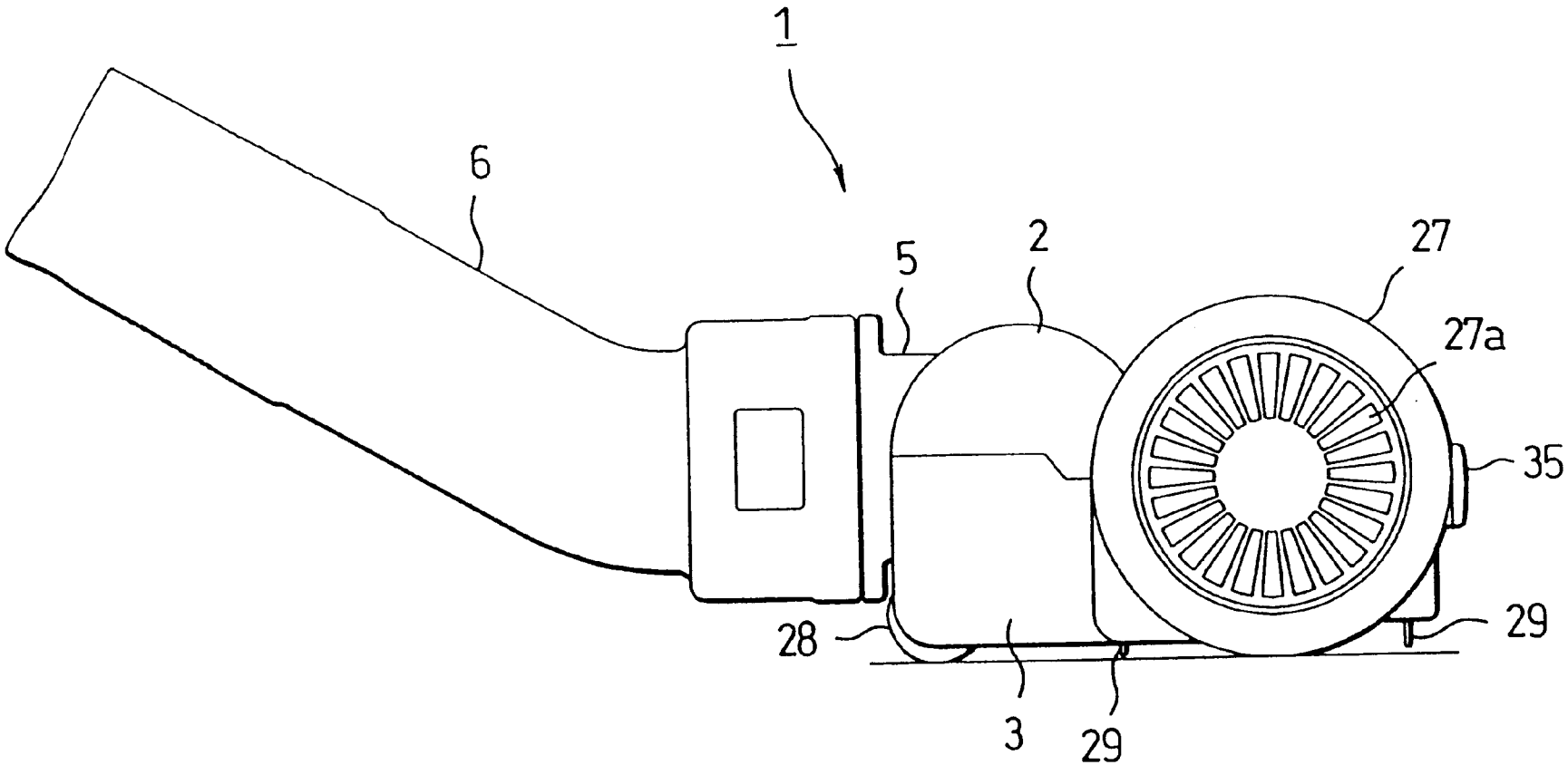
FIG. 35 is a side view of the dust suction head of FIG. 31.

Each of the front wheels 27 has a radial air suction port 27*a* similar to that shown in FIG. 35. Openings 9*a* and 10*a* are also formed through the bearing 9 of the head 1 and partitioning ribs 10 as shown in FIG. 32.

Figure 33:
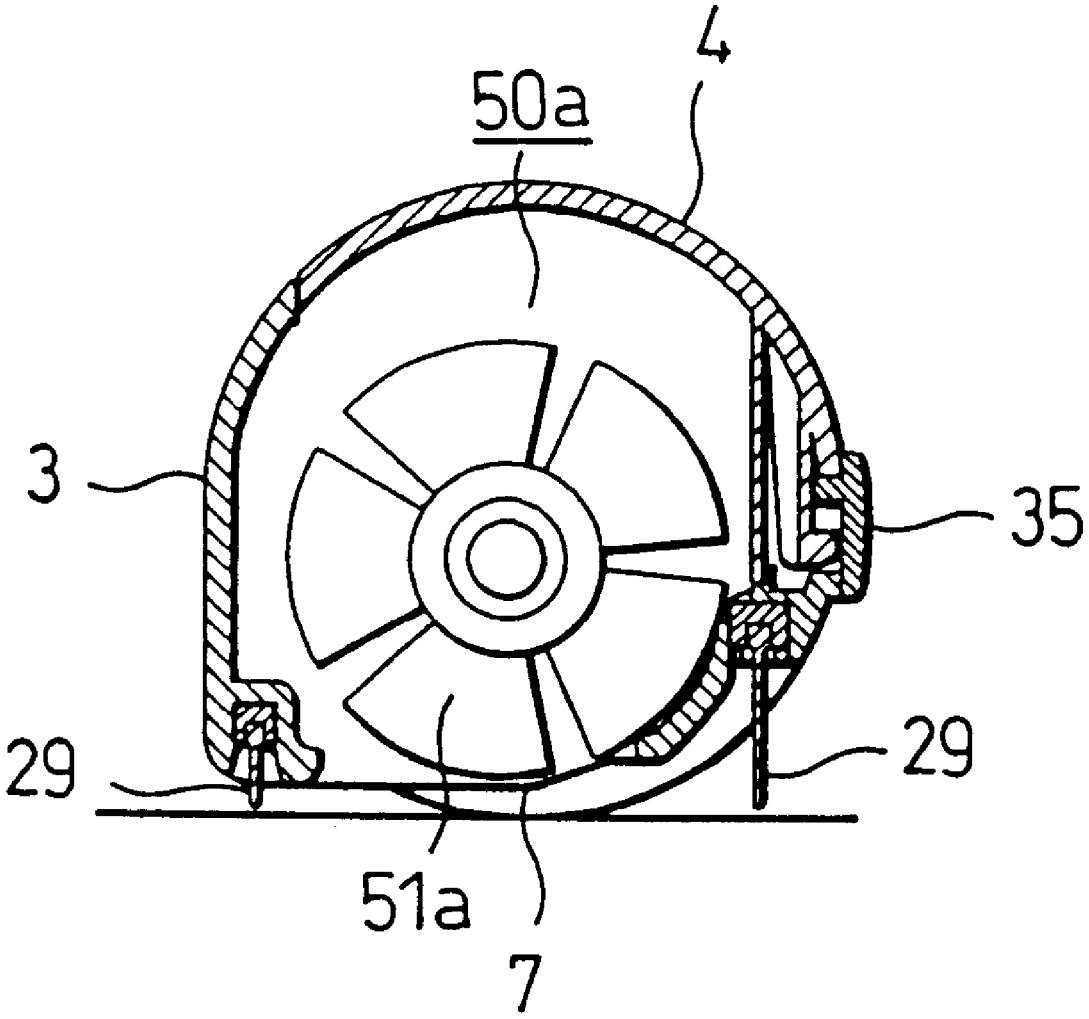
FIG. 33 shows, in detail, a transverse cross section of the dust suction head of FIG. 31.

Mounted on the opposite ends of the rotational brush 11 are propeller fan type turbines 50*a* whose rotor blades 51*a* are adapted to rotate in the clockwise direction as seen in FIG. 33 when fresh air is taken through the openings 27*a*, 9*a*, and 10*a*.

This arrangement has the same advantages as the previous ones. It is suited for smooth rotation of the propeller fan type turbines 50*a* and of the rotational brush 11.

Figure 36A:
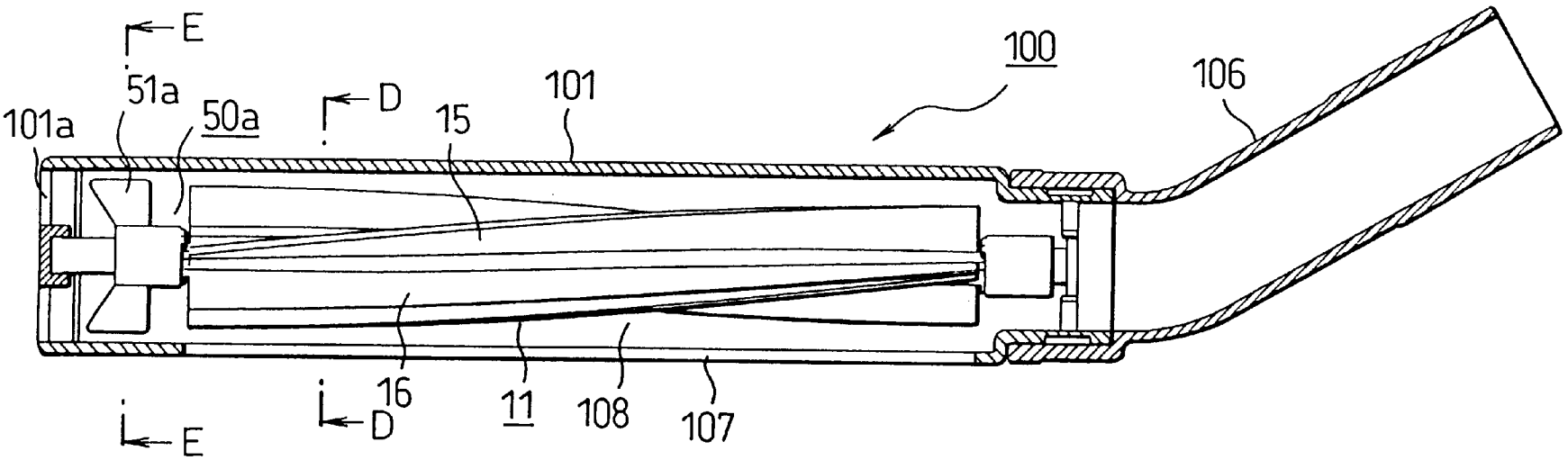
FIG. 36 illustrates a hand-held type dust suction head according to the invention, in longitudinal cross section (FIG. 36A); in cross section taken on line D—D of FIG. 36A (FIG. 36B); and in cross section taken on line E—E of FIG. 36A (FIG. 36C).
Figure 36B:
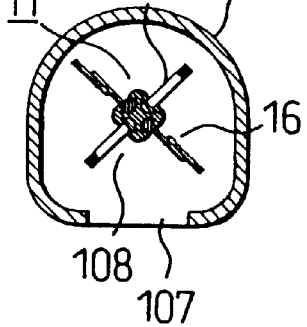
Figure 36C:
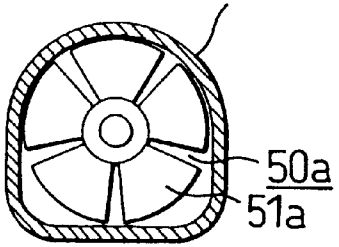
Figure 37A:
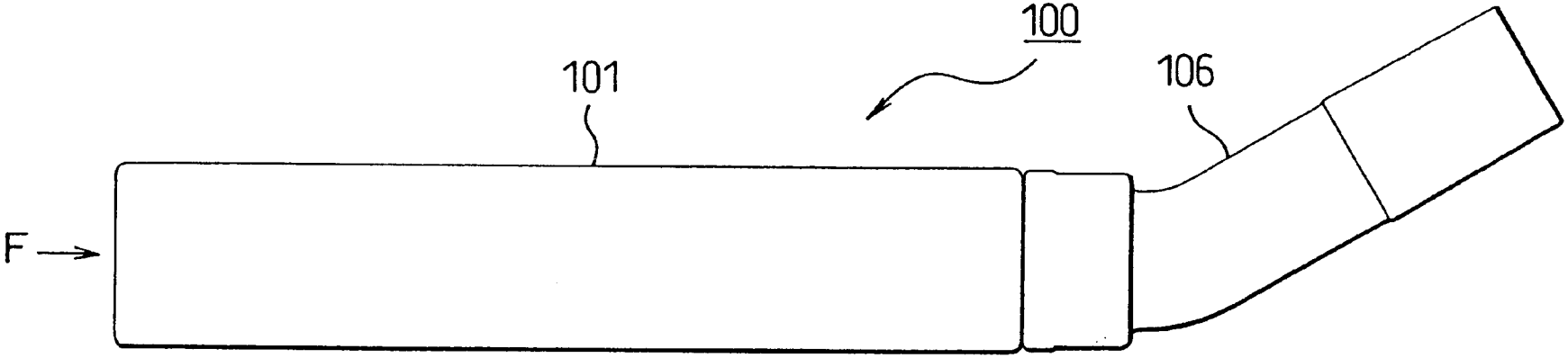
FIG. 37 illustrates another hand-held type dust suction head according to the invention, a side view (FIG. 37A); and in front view as seen in the direction of arrow F shown in FIG. 37A (FIG. 37B).
Figure 37B:
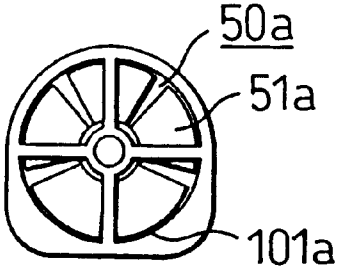

FIGS. 36 and 37 show a still further example of the invention.

The invention shown herein is a hand-held type dust suction head suited for cleaning a sofa, for example.

A dust suction head 100 includes a main case 101, a connection tube 106 rotatably supported at one end thereof by the main case 101. In contrast to the previous examples which require a rotatable tube 5 for rolling the dust suction head over a floor forward and backward, this example needs no such rotatable tube since this dust suction head is moved in the longitudinal direction of the head.

An air suction port 107, similar to the preceding one, is formed in the bottom of the dust suction head 100 (main case 101) for the rotational brush 11. A substantially cylindrical brush chamber 108 is formed inside the main case 101 for accommodating the rotational brush 11.

The rotational brush 11 is rotatably supported in the brush chamber 108. A propeller fan type turbine 50*a* is mounted on one end of the rotational brush 11.

In order to provide the turbine 50*a* with fresh air, an opening 101*a* is formed in one end of the main case 101 facing the turbine 50*a*.

The rotor blades 51*a* of the turbine 50*a* are adapted to rotate in the clockwise direction as seen in FIG. 36C while sucking air through the opening 101*a*. As shown in FIG. 36A, the blades 15 and 16 are also arranged to rotate together with the turbine 50*a* when it is accelerated by the fresh air coming from the opening 101*a* and the air suction port 107. That is, the blades 15 and 16 are curved to spiral along the shaft of the brush 11 such that they are acted on by a rotational force by the air streaming from the opening 101*a* to the connection tube 106.

As a result, in addition to the rotational force applied by the turbine 50*a*, the rotational brush 11 acquires a desirable rotational force acting on the blades 15 and 16 themselves. The rotational forces on the blades effectively facilitate rotation of the brush 11, especially, when it is operated on a very resistive floor such a sofa.

Figure 38A:
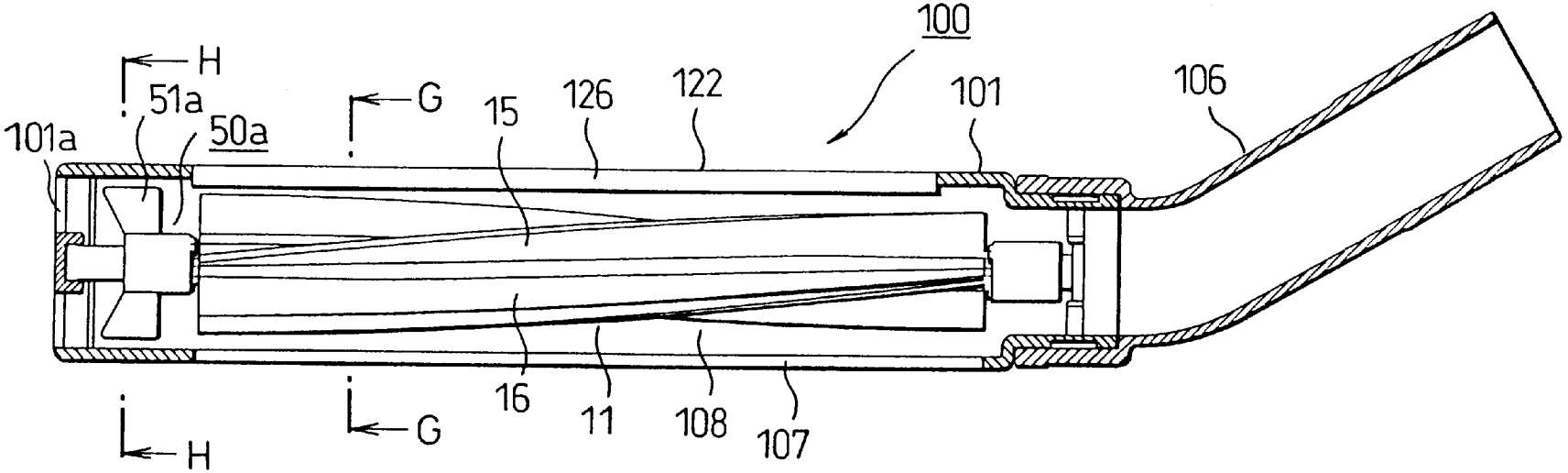
FIG. 38 illustrates still another hand-held type dust suction head according to the invention, in longitudinal cross section (FIG. 38A); in cross section taken on line G—G shown in FIG. 38A (FIG. 38B); and in cross section taken on line H—H shown in FIG. 38A (FIG. 38C).
Figure 38C:
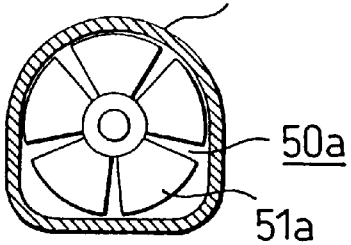
Figure 38B:
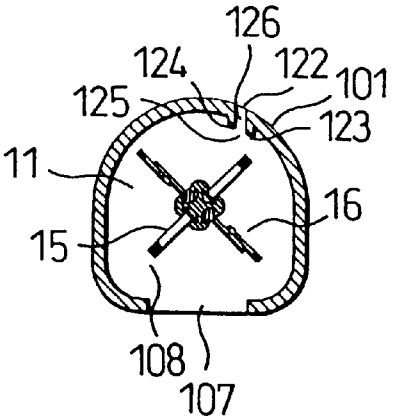
Figure 39A:
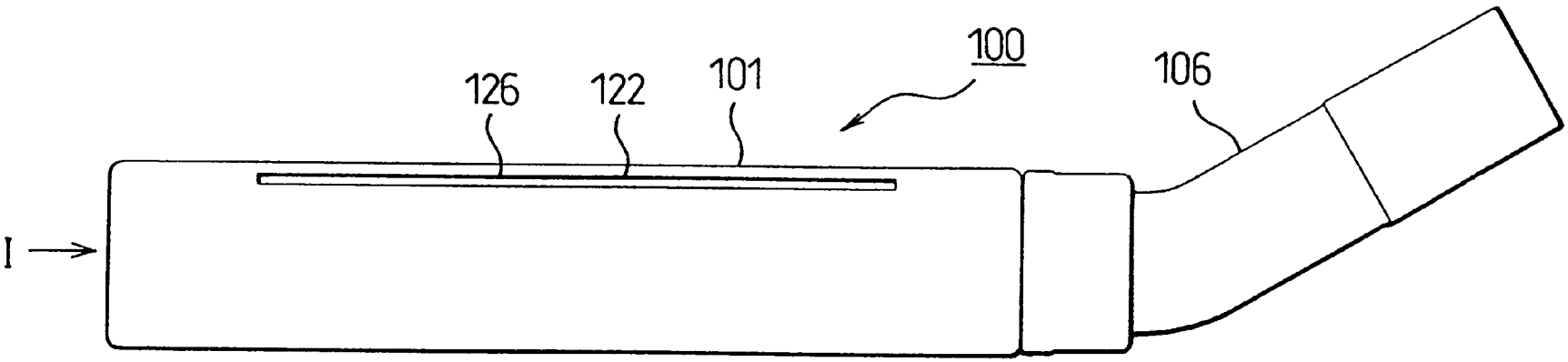
FIGS. 39A and 39B show respectively a side view and a front view, as seen in the direction of arrow I, of the dust suction head of FIG. 38.
Figure 39B:
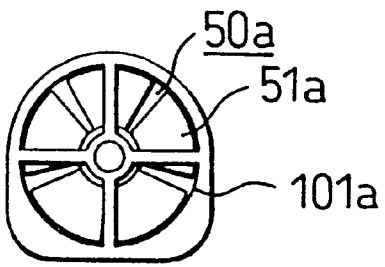
Figure 40:
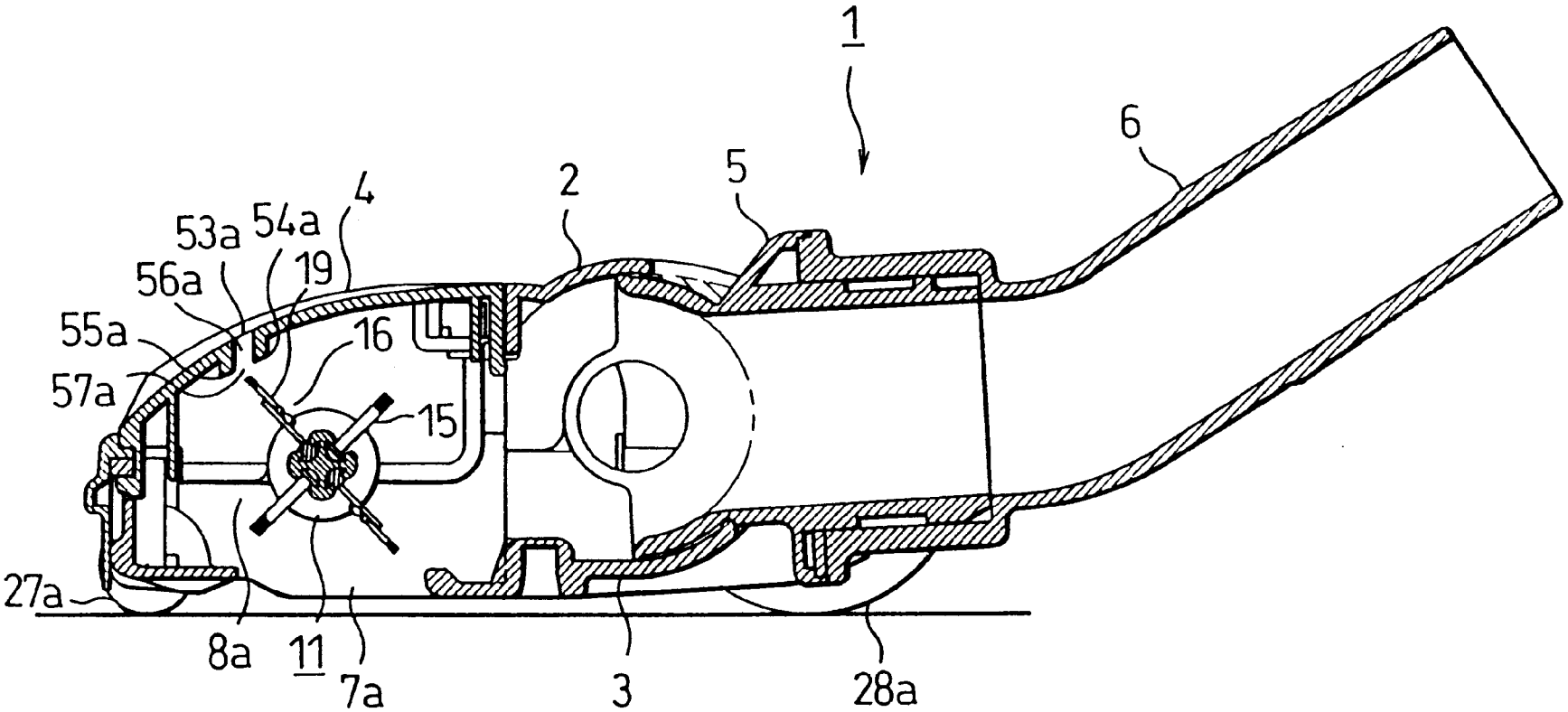
FIG. 40 is a longitudinal cross section of a still another dust suction head according to the invention.
Figure 41:
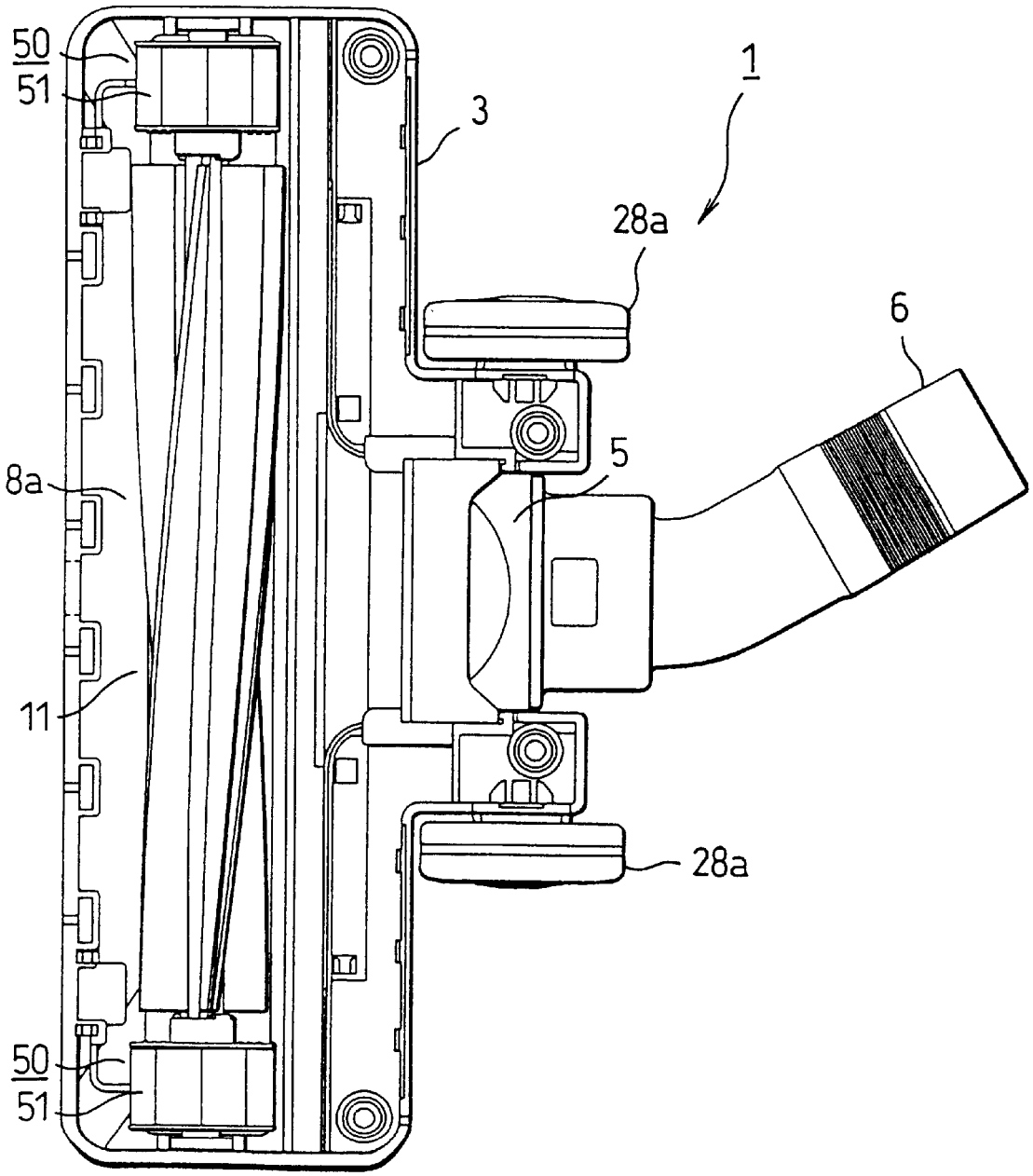
FIG. 41 is a plan view of the dust suction head of FIG. 40 with its cover removed.

FIGS. 38 and 39 show a still further example of the invention, which has the same feature of the example described in conjunction with FIGS. 36 and 37. In this example, the invention further comprises an air passage 126 connected with an upper opening or slit 122. The slit 122 has a length along the entire length of the rotational brush 11, in just the same manner as in the preceding example. The slit 122 is formed in the main case 101 and offset a little from the very top of the case 101 in the rotational direction of the brush 11. The first and the second ribs 123 and 124 are respectively formed on both sides of the air passage 126 for guiding the fresh air from the air passage 126 to the blades 15 and 16 to assist the rotation thereof. An outlet mouth 125 is formed at the tips of the ribs 123 and 124.

The dust suction head 1, having this arrangement, has an advantage over the preceding one in that this head can provide a further enhanced torque on the rotational brush 11.

FIGS. 40 through 45 show a still further example of the invention, applied to a general dust suction head for cleaning a floor. This example differs from the ones shown in FIGS. 23 through 35 in that the brush chamber 8*a* has a non-cylindrical configuration and that the front wheels 27*a* are smaller and the rear wheels 28*a* are larger than previous ones, respectively. This dust suction head, however, has the same basic structure as the previous ones in that this also has a turbine 50 on the opposite ends of the rotational brush 11.

Figure 42:
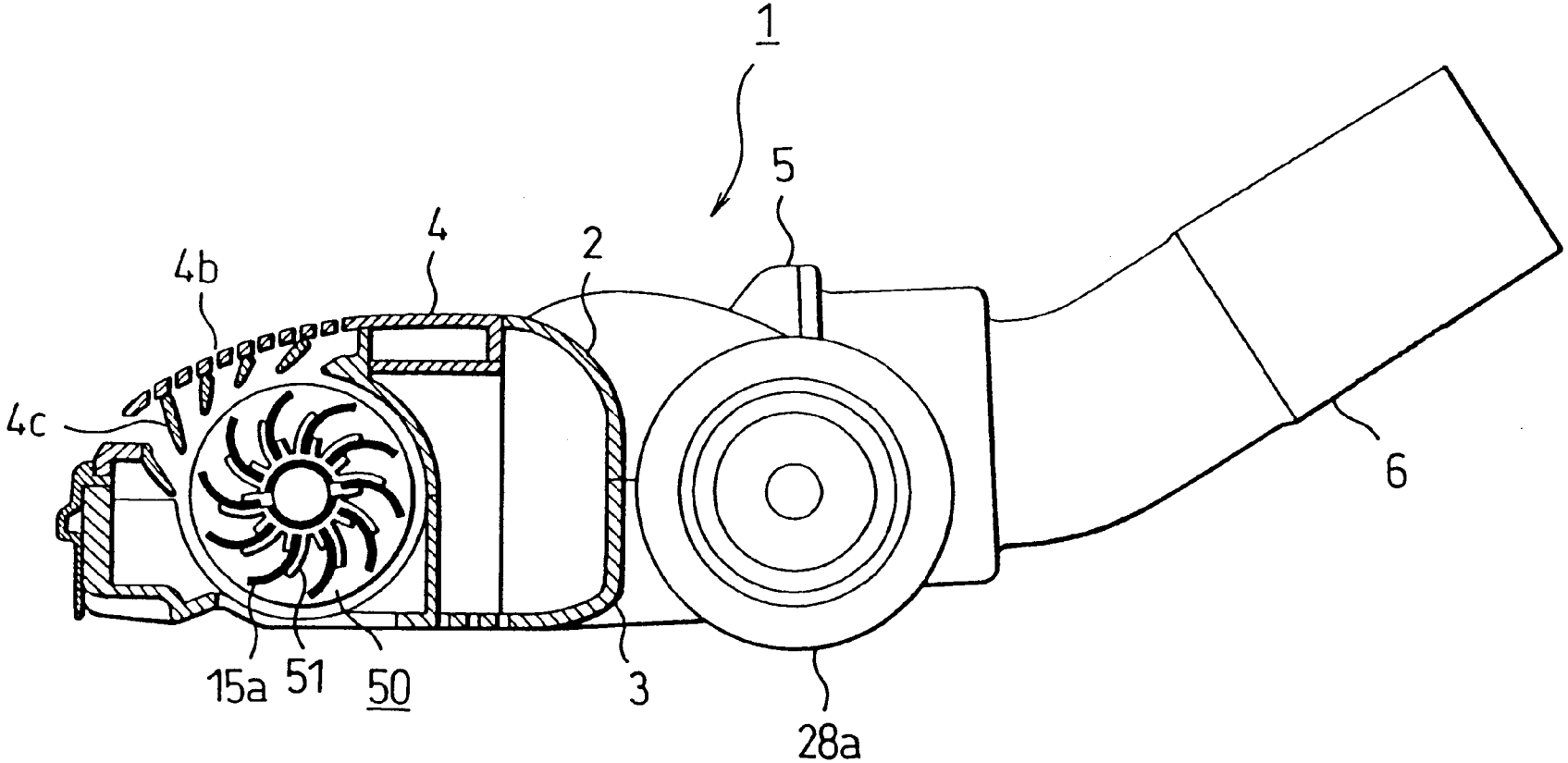
FIG. 42 is partial longitudinal cross section of the dust suction head of FIG. 40.
Figure 43:
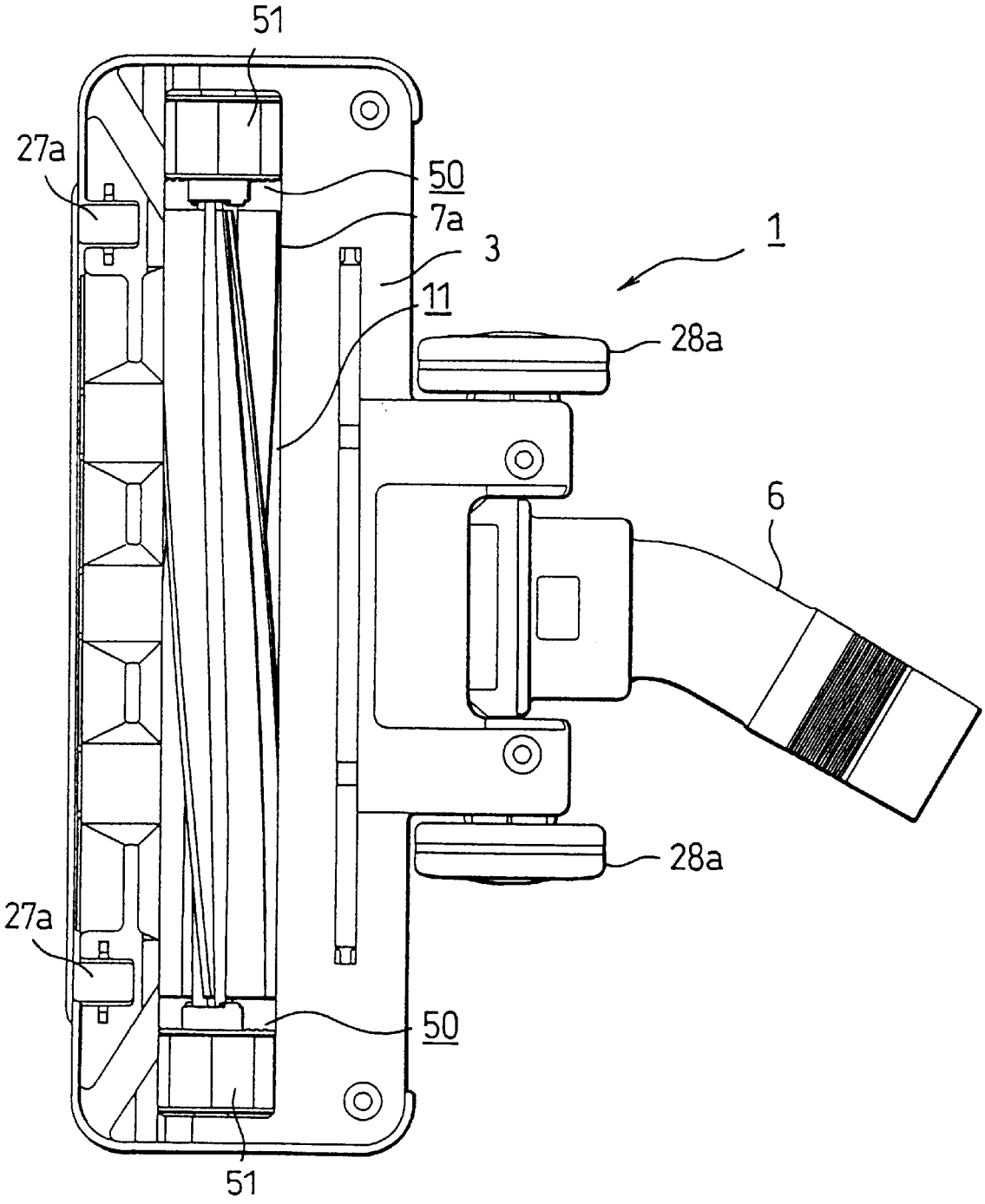
FIG. 43 is a bottom view of the dust suction head of FIG. 40.
Figure 44:
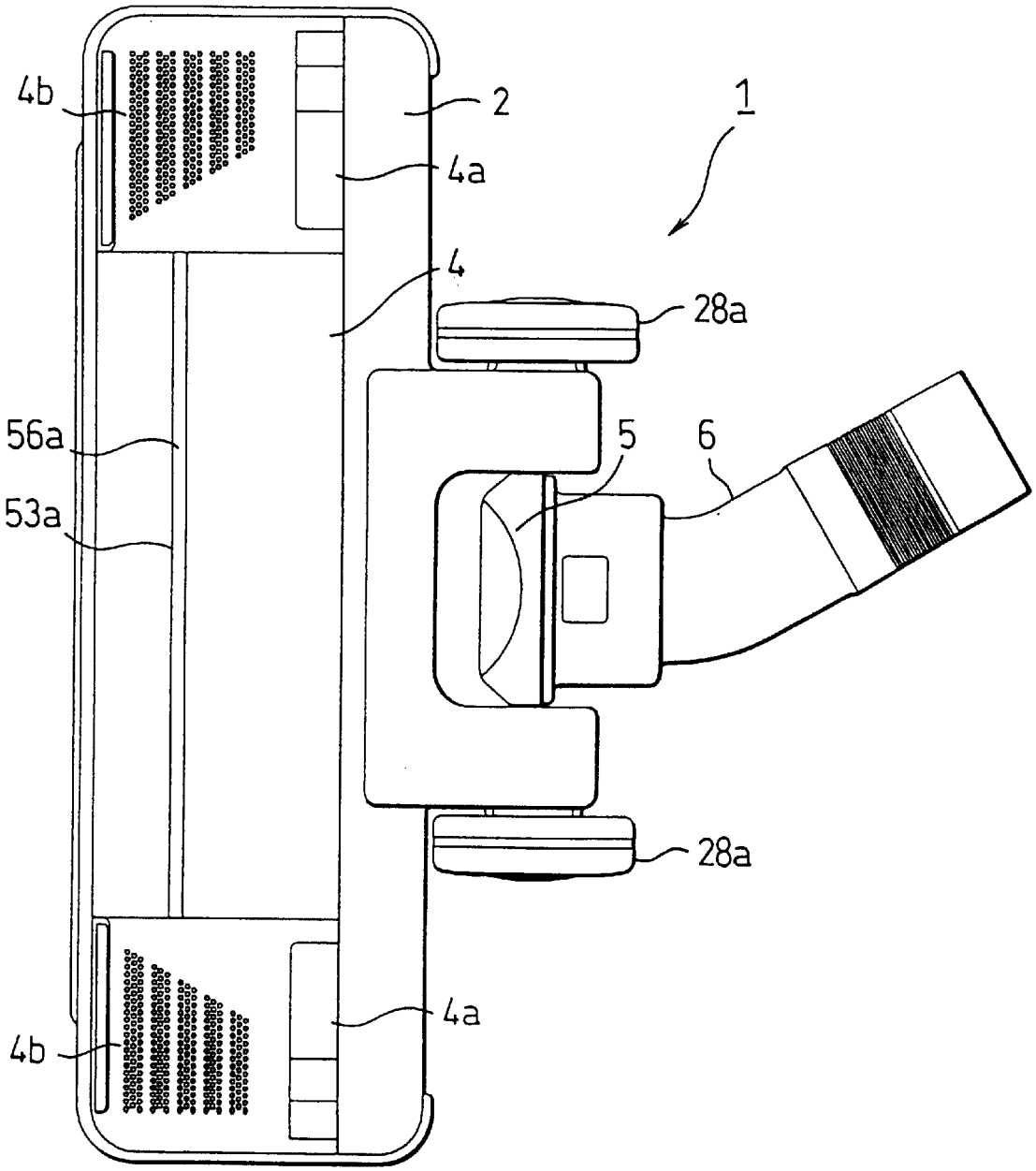
FIG. 44 is a plan view of the dust suction head of FIG. 40.
Figure 45:
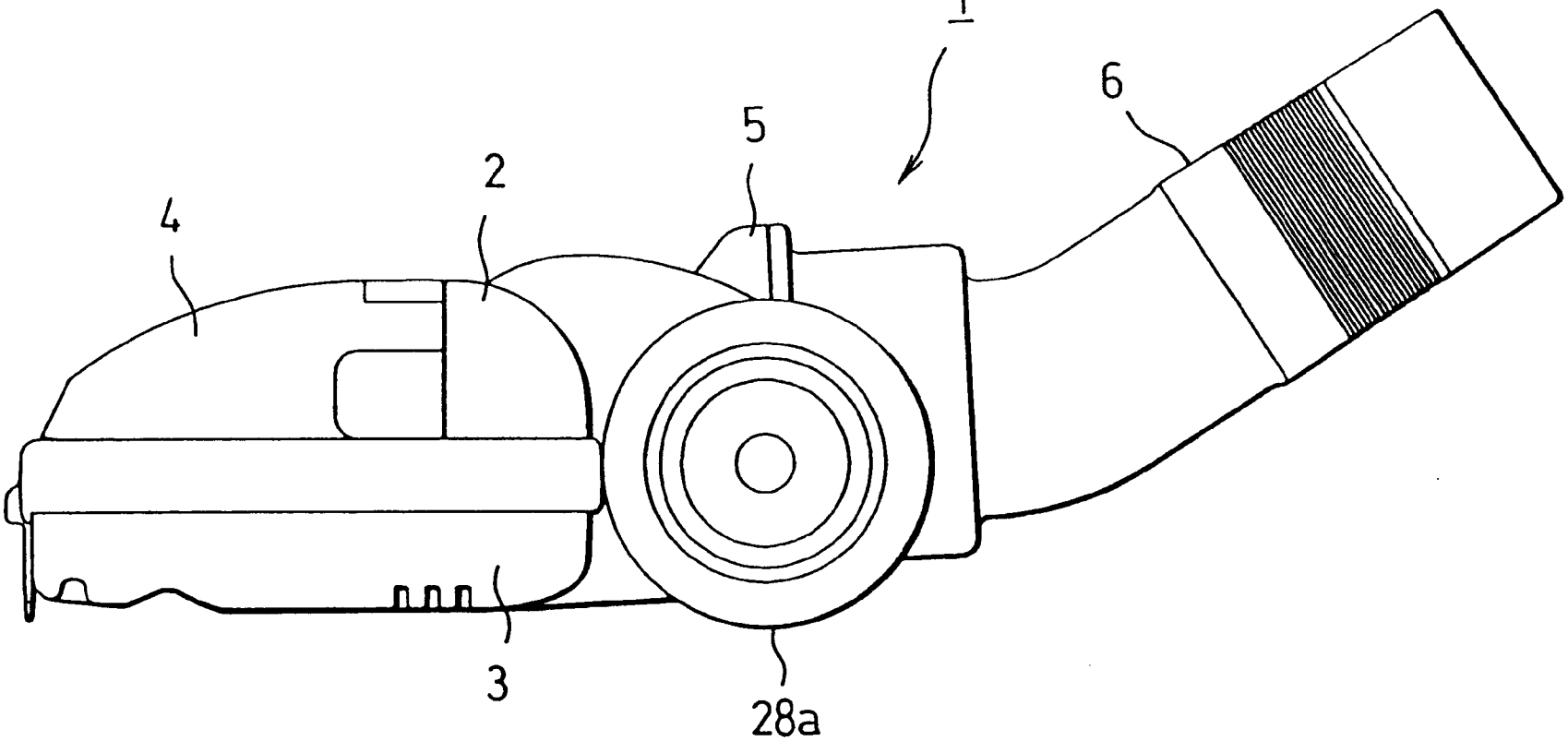
FIG. 45 is a side view of the dust suction head of FIG. 40.

A feature of this example lies in the fact that, as shown in FIG. 42, a brush member 15*a* is mounted on each of the rotational rotor blades 51 of the turbine 50, and that an air suction port 7*a* extends over the entire length of the rotational brush 11 plus the turbine 50 as shown in FIG. 43. Like the blades 15 mounted on the rotational brush 11, each of the brush members 15*a* may be formed of nylon or polyethylene. The tip portion of the brush member 15*a* stretches straight so as to sweep dust on a floor due to centrifugal force acting on it as the turbine 50 is rotated at a high speed.

It is noted that an elongate opening or slit 53*a* is formed in the lid 4 of the body and along substantially the entire length of the rotational brush 11. As in the previous examples, the first and the second ribs 54*a* and 55*a* are respectively formed at the front and rear ends, respectively, of the slit 53*a* for guiding the air taken in from the slit 53*a* to the blades 15 and 16 of the rotational brush 11. The ribs 54*a* and 55*a* together define an air passage 56*a*. The air passage 56*a* ends with a fresh air induction port 57*a*.

Perforated openings 4*b* are formed at the opposite ends of a lid 4. On the back of each perforated opening 4*b* is a guide 4*c* formed for guiding fresh air drawn through the opening 4*b* to the rotor blades 51 (forward) of the turbine 50 as shown in FIG. 42.

Thus, the rotational force acting on the blades 15 and 16 themselves as well as the rotational force of the turbine may together provide a torque needed for the rotational brush 11 to clean a frictional floor such as a carpet. Since the elongate air suction port 7*a* extends over the turbine, the dust swept by the brush member 15*a* mounted on the turbine 50 may be well removed.

In the example shown herein, the brush members 15*a* may be replaced by blades, or by a combination of the brush members 15*a* and the rotor blades 51.

Also, the rotational brush 11 may have only the blades 15 or the blades 16. If the rotational brush 11 is formed solely of poorly permeable blades 16, the rotational force will be further enhanced, but the blades 15 made of a permeable material will normally be adequate in acquiring a required rotational force to clean a carpet for example, because the blades 15 are assisted by the turbine 50.

What is claimed is:

1. A dust suction head for use in an electric vacuum cleaner, comprising:

a body having in the bottom thereof an air suction port;

a brush chamber formed in said body;

a freely rotatable rotational brush mounted on a shaft within said brush chamber and having a multiplicity of flexible blades mounted on said shaft along the length of said shaft; and an opening formed in an upper portion of said body for taking in fresh air and guiding the fresh air to said blades so as to assist rotation of said rotational brush.

2. A dust suction head for use in an electric vacuum cleaner, comprising:

a body having in the bottom thereof an air suction port;

a brush chamber formed in said body;

a freely rotatable rotational brush mounted on a shaft within said brush chamber and having a multiplicity of flexible blades helically mounted on said shaft along the length of said shaft; and an opening formed apart from said suction port, for taking in fresh air, said opening extending at an angle with said blades such that the fresh air is constantly provided obliquely to said blades regardless of the angular position of said rotational brush.

3. The dust suction head for use in an electric vacuum cleaner according to claim 1 or claim 2, further comprising an air passage for leading said fresh air from said opening to those blades of said rotational brush extending forward from said shaft.

4. The dust suction head for use in an electric vacuum cleaner according to claim 1 or claim 2, wherein at least a part of said blades is made of a non-permeable material.

5. The dust suction head for use in an electric vacuum cleaner according to claim 1 or claim 2, wherein said blades are bent in the direction opposite to the rotational direction of said blades.

6. The dust suction head for use in an electric vacuum cleaner according to claim 1 or claim 2, wherein said opening is formed in said body at a substantially central position along the width of said body.

7. The dust suction head for use in an electric vacuum cleaner according to claim 1 or claim 2, further comprising a guide for guiding said fresh air from said opening to those blades situated below said shaft.

8. The dust suction head for use in an electric vacuum cleaner according to claim 1 or claim 2, wherein said brush chamber has a substantially round form in vertical cross section of said brush chamber.

9. The dust suction head for use in an electric vacuum cleaner according to claim 1 or claim 2, wherein said rotational brush is vertically moveable within said brush chamber.

10. The dust suction head for use in an electric vacuum cleaner according to claim 1 or claim 2, further comprising at least one fan mounted on said shaft of said rotational brush, said fan rotatable when it receives fresh air through said opening.

11. The dust suction head for use in an electric vacuum cleaner according to claim 1 or claim 2, further comprising additional blades formed on said shaft of said rotational brush, said additional blades adapted to facilitate rotation of said rotational brush when they receive fresh air through said opening.

12. A dust suction head for use in an electric vacuum cleaner, comprising:

a body having in the bottom thereof an air suction port;

a brush chamber formed in said body;

a freely rotatable rotational brush mounted on a shaft within said brush chamber and having a multiplicity of flexible blades mounted on said shaft along the length of said shaft; and an opening formed in said body for taking in fresh air and guiding the fresh air to said blades so as to assist rotation of said rotational brush, wherein said blades are formed such that said blades are bent away from a radial direction from said shaft so that said blades do not touch a floor to be cleaned when said rotational brush is not rotated, and said blades are extended by centrifugal force to touch the floor when said rotational brush is rotated.

13. The dust suction head for use in an electric vacuum cleaner according to claim 12, further comprising an air passage for leading said fresh air from said opening to those blades of said rotational brush extending forward from said shaft.

14. The dust suction head for use in an electric vacuum cleaner according to claim 12, wherein at least a part of said blades is made of a non-permeable material.

15. The dust suction head for use in an electric vacuum cleaner according to claim 12, wherein said blades are bent in a direction opposite to a rotational direction of said blades.

16. The dust suction head for use in an electric vacuum cleaner according to claim 12, wherein said opening is formed in said body at a substantially central position along the width of said body.

17. The dust suction head for use in an electric vacuum cleaner according to claim 12, further comprising a guide for guiding said fresh air from said opening to those blades situated below said shaft.

18. The dust suction head for use in an electric vacuum cleaner according to claim 12, wherein said opening extends in a direction to intersect a multiplicity of said blades.

19. The dust suction head for use in an electric vacuum cleaner according to claim 12, wherein said brush chamber has a substantially round form in vertical cross section of said brush chamber.

20. The dust suction head for use in an electric vacuum cleaner according to claim 12, wherein said rotational brush is vertically moveable within said brush chamber.

21. The dust suction head for use in an electric vacuum cleaner according to claim 12, further comprising at least one fan mounted on said shaft of said rotational brush, said fan rotatable when it receives fresh air through said opening.

22. The dust suction head for use in an electric vacuum cleaner according to claim 12, further comprising additional blades formed on said shaft of said rotational brush, said additional blades adapted to facilitate rotation of said rotational brush when they receive fresh air through said opening.

* * * * *